US005883057A

United States Patent [19]

Roell, Jr. et al.

[11] Patent Number: 5,883,057

[45] Date of Patent: Mar. 16, 1999

[54] LUBRICATING COMPOSITIONS

[75] Inventors: Bernard C. Roell, Jr., Willoughby; Curtis R. Scharf, Painesville; Robert C. Richardson, Mentor, all of Ohio

[73] Assignee: The Lubrizol Corporation, Wickliffe, Ohio

[21] Appl. No.: 953,698

[22] Filed: Oct. 17, 1997

Related U.S. Application Data

[63] Continuation of Ser. No. 599,426, Jan. 16, 1996, abandoned.

[51] Int. Cl.[6] ..... C10M 143/00; C10M 145/00

[52] U.S. Cl. ..... 508/469; 585/14

[58] Field of Search ..... 508/469; 585/14

[56] References Cited

U.S. PATENT DOCUMENTS

| | | | |
|---|---|---|---|
| 3,637,503 | 1/1972 | Giannetti et al. | 252/59 |
| 3,994,815 | 11/1976 | Coleman | 252/52 |
| 4,031,020 | 6/1977 | Sugiura et al. | 252/56 |
| 4,162,985 | 7/1979 | Holubec | 252/32.7 |
| 4,299,714 | 11/1981 | Sugiura et al. | 252/73 |
| 4,594,378 | 6/1986 | Tipton et al. | 524/106 |
| 4,654,403 | 3/1987 | Tipton | 525/194 |
| 4,734,446 | 3/1988 | Tipton | 524/106 |
| 4,912,272 | 3/1990 | Wu | 585/10 |
| 4,956,122 | 9/1990 | Watts et al. | 252/565 |
| 4,968,853 | 11/1990 | Scharf | 585/10 |
| 4,990,711 | 2/1991 | Chen et al. | 585/302 |
| 5,012,020 | 4/1991 | Jackson et al. | 585/10 |
| 5,089,156 | 2/1992 | Chrisope et al. | 252/49.9 |
| 5,105,038 | 4/1992 | Chen et al. | 585/10 |
| 5,146,021 | 9/1992 | Jackson et al. | 585/10 |
| 5,151,205 | 9/1992 | Culpon, Jr. | 252/56 |
| 5,157,177 | 10/1992 | Pelrine et al. | 585/10 |
| 5,180,865 | 1/1993 | Heilman et al. | 585/10 |
| 5,210,362 | 5/1993 | Sowerby et al. | 585/532 |
| 5,217,636 | 6/1993 | Paboucek | 252/56 |
| 5,360,562 | 11/1994 | Chrisope et al. | 585/46.5 |
| 5,364,994 | 11/1994 | Scharf | 585/3 |
| 5,387,346 | 2/1995 | Hartley et al. | 252/49.9 |

FOREIGN PATENT DOCUMENTS

| | | |
|---|---|---|
| 736464 | 6/1966 | Canada . |
| 1043322 | 11/1978 | Canada . |
| 136377 | 9/1983 | European Pat. Off. . |
| 129414 | 6/1984 | European Pat. Off. . |
| 276320 | 7/1987 | European Pat. Off. . |
| 281060 | 3/1988 | European Pat. Off. . |
| 578435 | 6/1993 | European Pat. Off. . |
| 678569 | 4/1995 | European Pat. Off. . |
| 2245757 | 12/1973 | France . |
| 2524118 | 12/1975 | Germany . |
| 2161828 | 6/1985 | United Kingdom . |
| 8901507 | 2/1989 | WIPO . |
| 9506700 | 3/1995 | WIPO . |
| 9506701 | 3/1995 | WIPO . |

OTHER PUBLICATIONS

EP 97 30 0215, European Search Report mailed Jul. 14, 1997.

*Primary Examiner*—Jacqueline V. Howard
*Attorney, Agent, or Firm*—Renner, Otto, Boisselle & Sklar

[57] ABSTRACT

This invention relates to a lubricating composition comprising at least about 30% by weight of at least one mineral oil, having a kinematic viscosity of less than about 8 cSt at 100° C., (A) from about 5% to about 30% by weight at least one polymer having a $\bar{M}w$ less than about 10,000, and (B) from about 2% to about 12% by weight of a polymer having a $\bar{M}w$ greater than about 15,000, wherein the lubricating composition has a shear loss of less than about 15% in the 20 hour taper bearing shear test. The invention also relates to concentrates used in preparing shear stable lubricating compositions. The present combination of components provides good low and high temperature properties to mineral oils, even at high treat levels. These lubricants have good shear stability and in one aspect have improved oxidation resistance.

24 Claims, No Drawings

LUBRICATING COMPOSITIONS

This is a continuation of application Ser. No. 08/599,426 filed on Jan. 16, 1996, now abandoned.

TECHNICAL FIELD OF THE INVENTION

This invention relates to lubricating compositions, especially gear oil compositions having good low and high temperature viscometrics and which exhibit good shear stability. More specifically, the invention relates to combinations of polymers which provide good viscometrics and shear stability to lubricants.

BACKGROUND OF THE INVENTION

Multigrade lubricants are preferred because of their ability to operate under broad temperature ranges. High molecular weight polymers have been used in multigrade lubricants to maintain oil viscosity as equipment operating temperatures increase. A problem with the use of high molecular weight polymers is their shear stability. Shear stability describes the polymer's ability to maintain oil viscosity after exposure to shearing conditions. Shear stability is a measure of the loss of polymer's ability to provide thickening to a fluid. This loss is typically referred to as permanent shear loss (PSL). One way of measuring permanent shear loss is the Taper Bearing Shear Test (DIN 350-06). The viscosity of a lubricant is measured before and after the test and the percentage of shear loss is reported. Today's lubricating compositions are exposed to high shear conditions, such as gear driveline applications. A need exists for shear stable polymers.

Low molecular weight polymers may be used to prepare multigrade lubricants. Often high treat rates for the low molecular weight polymers are required to obtain appropriate viscosity. A disadvantage of these polymers is their affect on low temperature viscometrics as measured in the Brookfield viscometer. Multigrade lubricants must have acceptable low temperature properties, e.g. acceptable viscosity at low temperatures. It is desirable to have ingredients which can form multigrade lubricants, especially gear, transmission and differential lubricants with good low and high temperature viscometrics and acceptable shear stability.

Multigrade lubricants have been made from synthetic, e.g., polyalphaolefin fluids, and natural base fluids. However, the costs of the synthetic fluids is high compared to mineral oils. With mineral oils (e.g. up to SAE 250N), it is difficult to obtain good viscometrics, i.e. kinematic viscosity and/or Brookfield viscosity. More specifically, the amount of polymer needed to thicken the oil causes undesirable low temperature viscosity. The low temperature viscosity is measured in a Brookfield viscometer.

Lubricating compositions serve to remove heat from operating equipment and to reduce metal-metal contact which lead to wearing. Today many pieces of equipment are reduced in size, which in turn has led to higher operating temperatures for the equipment. These higher temperatures, along with exposure to oxidizing media, such as air or water, may lead to increased oxidation of the lubricating composition. Today the drain intervals for lubricants have increased. When a lubricant has to operate for longer periods at higher temperatures, the lubricant is prone to viscosity increase. The viscosity increase is believed to be caused by polymerization of oxidized components of the lubricants. This increased viscosity renders the lubricant unfit for use. It is therefore desirable to have lubricants with improved oxidation resistance. More particularly, it is desirable to have lubricants which will withstand long periods of operation at high temperatures. A need exists for components which can provide the desired viscometrics for mineral oil based lubricants while also being shear stable and have good low temperature performance. Additionally a need exist for lubricants which can meet the above requirements and which provide improved oxidation resistance.

SUMMARY OF THE INVENTION

This invention relates to a lubricating composition comprising at least about 30% by weight of at least one mineral oil, having a kinematic viscosity of less than about 8 cSt at 100° C., (A) from about 5% to about 30% by weight at least one polymer having an $\overline{M}w$ less than about 10,000, and (B) from about 2% to about 12% by weight of a polymer having a $\overline{M}w$ greater than about 15,000, wherein the lubricating composition has a shear loss of less than about 15% in the 20 hour taper bearing shear test. In one aspect, the lubricating compositions may also include (C) from about 5% to about 30% by weight of at least one fluidizing agent. The invention also relates to concentrates used in preparing shear stable lubricating compositions. The present combination of components provides good low and high temperature properties to mineral oils, even at high treat levels. These lubricants have good shear stability and in one aspect have improved oxidation resistance.

DETAILED DESCRIPTION OF THE PREFERRED EMBODIMENT

The term "hydrocarbyl" includes hydrocarbon as well as substantially hydrocarbon groups. Substantially hydrocarbon describes groups which contain heteroatom substituents that do not alter the predominantly hydrocarbon nature of the substituent. Examples of hydrocarbyl groups include the following:

(1) hydrocarbon substituents, i.e., aliphatic (e.g., alkyl or alkenyl) and alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g. pyridyl, furyl, thienyl, imidazolyl, etc.

In general, no more than about 2, preferably no more than one heteroatom substituent will be present for every ten carbon atoms in the hydrocarbyl group. Typically, there will be no such heteroatom substituents in the hydrocarbyl group. Therefore, the hydrocarbyl group is hydrocarbon.

As use herein the term "mineral oil" refers to oils of lubricating viscosity which are derived from petroleum crude. The mineral oils include distilled oils, solvent refined oils, isomerized waxes, hydrocracked and hydrogenated base stocks, rerefined oils, etc. It is understood that mixtures of two or more mineral oils may be used.

As described above, the lubricating compositions and concentrates contain a combination of ingredients which provides good low and high temperature viscometrics and good shear stability. Shear stability is measured in the 20 hour taper bearing shear test. The Tapered Bearing Shear Test is a published standard test entitled "Viscosity Shear Stability of Transmission Lubricants" and is described in CEC L-45-T-93 available from CEC, 61 New Cavendish Street, London WIM 8AR, England. The same test is also published as DIN 51 350, part 6 and is available from Deutsches Institue für Normung, Burggrfenshase 6, 1000 Berlin 30, Germany. Both references are hereby incorporated by reference. The lubricating compositions generally give a shear loss of less than 20% shear loss, preferably less than about 18%, more preferably less than about 15% in the tapered bearing shear test. Also the lubricating compositions provide a Brookfield viscosity of less than about 160,000, or less about 150,000, or less than about 140,000 cPs at −40° C. Typically, the lubrication compositions have a Brookfield viscosity of greater than 20,000, or greater than 40,000 or, greater than about 50,000 cPs at −40° C.

The lubricating compositions are prepared from at least one mineral oil having a kinematic viscosity of less than 8 cSt, or less than about 7 cSt, or less than about 6 cSt at 100° C. Of course, it is understood that the mineral oil must be of sufficient viscosity to act as a lubricating oil. Typically the mineral oil has a kinematic viscosity of at least about 2, or at least about 3, or at least about 4 cSt at 100° C. The mineral oil is generally present in an amount at least about 30%, or at least about 40%, or at least a major amount by weight.

In one embodiment, the mineral oil has an iodine value of less than about 9. Iodine value is determined according to ASTM D-460. In another embodiment, the oil of lubricating viscosity has an iodine value less than about 8, or less than about 6, or less than about 4. In another embodiment, the oil of lubricating viscosity has less than 0.3% or less than 0.1% sulfur. In another embodiment, the mineral oil is other than petroleum bright stock. In one aspect, the lubricating compositions are free of petroleum bright stocks.

Mineral oils include petroleum oils, and treated petroleum oils. The mineral oils may be a paraffinic, naphthenic and/or aromatic types. Specific mineral oils include hydrotreated mineral oils, solvent refined mineral oils, isomerized wax oils, solvent refined and acid treated mineral oils, etc. Typically, the mineral oils will have an SAE designation up to about 250N, or up to about 150N. Useful oils include 70N, 100N, 130N, 150N and 200N mineral oils. In one embodiment, the mineral oil is a petroleum oil or a hydrotreated petroleum oil. Examples of useful oils of lubricating viscosity include isomerized wax basestocks, such as 100N isomerized wax basestocks, 120N isomerized wax basestocks, 170N isomerized wax basestocks, and 250N isomerized wax basestocks; refined basestocks, such as 250N solvent refined paraffinic mineral oils, 200N solvent refined naphthenic mineral oils, 100N solvent refined/hydrotreated paraffinic mineral oils, 240N solvent refined/hydrotreated paraffinic mineral oils, 80N solvent refined/hydrotreated paraffinic mineral oils, and 150N solvent refined/hydrotreated paraffinic mineral oils. A description of mineral oils occurs in U.S. Pat. No. 4,582,618 (column 2, line 37 through column 3, line 63, inclusive), herein incorporated by reference for its disclosure to oils of lubricating viscosity.

Polymer (A)

The lubricating compositions additionally contain (A) at least one polymer having a $\overline{M}w$ of less than 10,000. The polymer generally is present in an amount from about 5% to about 30%, or from about 10% to about 25%, or from about 12% to about 20% by weight of the lubricating composition. Here, and elsewhere in the specification and claims, the ratio and range limits may be combined. The polymers include a polyalkene or derivative thereof, an ethylene-α-olefin copolymer, an ethylene-propylene polymer, an α-olefin-unsaturated carboxylic reagent copolymer, a polyacrylate, a polymethacrylate, a hydrogenated interpolymer of an alkenylarene and a conjugated diene, and mixtures thereof. Here, as well as elsewhere, any member of a genus (or list) may be excluded from the genus.

In one embodiment, the polymer (A) is characterised by a $\overline{M}w$ (weight average molecular weight) of less than about 10,000, or less than about 9,000, or less than about 8,000. Typically the polymer has a $\overline{M}w$ of at least about 1,000, or at least about 2,000, or at least about 3,000. In another embodiment, the polymers have a $\overline{M}n$ (number average molecular weight) of up to about 6000, or up to about 5000. Generally, the polymer is characterized by having a $\overline{M}n$ from about 800 to about 6000, or from about 900 to about 5000, or from about 1000 to 4000. In another embodiment, the polymers have a $\overline{M}n$ from about 1300 to about 5000, or from about 1500 to about 4500, or from about 1700 to about 3000. The polymers also generally have a $\overline{M}w/\overline{M}n$ from about 1.5 to about 8, or from about 1.8 to about 6.5, or from about 2 to about 5.5.

The abbreviation $\overline{M}w$ and $\overline{M}n$ are the conventional symbols representing weight average molecular weight and number average molecular weight, respectively. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC. The techniques for determining $\overline{M}n$ and $\overline{M}w$ values of polymers are well known and are described in numerous books and articles. For example, methods for the determination nation of $\overline{M}n$ and molecular weight distribution of polymers is described in W. W. Yan, J. J. Kirkland and D. D. Bly, "Modern Size Exclusion Liquid Chromatographs", J. Wiley & Sons, Inc., 1979.

In one embodiment, the polymer may be a sheared polymer of high molecular weight, e.g. greater than $\overline{M}w$=10,000. In this embodiment, the polymer is sheared to the desired molecular weight, such as those above. The shearing may be done in any suitable apparatus, such as an extruder, an injector, an FZG apparatus, etc.

In one embodiment, the polymer (A) is a polyalkene. The polyalkene includes homopolymers and interpolymers of olefins having from 2 to about 40, or from 3 to about 24, or from 4 to about 12 carbon atoms. The olefins may be monoolefins, such as ethylene, propylene, 1-butene, isobutene, an α-olefin, or polyolefinic monomers, including diolefinic monomers, such 1,3-butadiene and isoprene. The α-olefins generally have from about 4 to about 30, or from about 8 to about 18 carbon atoms. These olefins are sometimes referred to as mono-1-olefins or terminal olefins. The α-olefins and isomerized α-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, etc. Commercially available α-olefin fractions that can be used include the $C_{15-18}$ α-olefins, $C_{12-16}$ α-olefins, $C_{14-16}$ α-olefins, $C_{14-18}$ α-olefins, $C_{16-18}$ α-olefins, $C_{16-20}$ α-olefins, $C_{18-24}$ α-olefins, $C_{22-28}$ α-olefins, etc. The polyalkenes are prepared by conventional procedures. The polyalkene are described in U.S. Pat. Nos. 3,219,666 and 4,234,435, the disclosures of which is hereby incorporated by reference. Examples of polyalkenes includes polypropylenes, polybutylenes, polyisoprene and polybutadienes. In one embodiment, the polyalkene is a homopolymer, such as a polybutene. One example of a useful polybutene is a polymer where about 50% of the polymer is derived from isobutylene. Useful polybutenes are those having a $\overline{M}w$ from about 3,000 to about 9,000, or from 4,000 to about 8,000, or about 6,700.

In one embodiment, the polyalkene is derived from one or more dienes. The dienes include 1,3 pentadiene, isoprene, methylisoprene, 1,4-hexadiene, 1,5-hepatadiene, 1–6-octadiene, 5-ethylidene-2-norbornene, 5-methylene-2-norbornene, linear 1,3-conjugated dienes (e.g. 1,3-butadiene, 2,3-dimethyl-1,3-butadiene, and 1,3-hexadiene) and cyclic dienes (e.g. cyclopentadiene, dicyclopentadiene, fulvene, 1,3-cyclohexadiene, 1,3,5-cycloheptatriene, and cyclooctatetraene). The polyalkene may be a homopolymer of a diene, or a co- or terpolymer of a diene with either another diene or one or more of the above monoolefins.

In another embodiment, the polymer is a derivative of a polyalkene. The derivatives are typically prepared by reacting a polyalkene, such as those discused herein, with an unsaturated reagent. The unsaturated reagents include unsaturated amines, ethers, and unsaturated carboxylic reagents, such as unsaturated acids, esters, and anhydrides. Examples of unsaturated amines include unsaturated amides, unsaturated imides, and nitrogen contaning acrylate and methacrylate esters. Specific examples of unsaturated amines include acrylamide, N,N'-methylene bis(acrylamide), methacrylamide, crotonamide, N-(3,6-diazaheptyl) maleimide, N-(3-dimethylaminopropyl)maleimide, N-(2-methoxyethoxyethyl)maleimide, N-vinyl pyrrolidinone, 2- or 4-vinyl pyridine, dimethylaminoethyl methacrylate and the like.

In one embodiment, the unsaturated carboxylic reagent is an acid, anhydride, ester, or mixtures thereof. If an ester is desired, it can be prepared by reacting an unsaturated carboxylic acid or anhydride with a polyalkene or halogenated derivative thereof and subsequently reacting the reaction product with an alcohol to form the ester. The unsaturated carboxylic reagents include acrylic acid, methacrylic acid, cinnamic acid, crotonic acid, 2-phenylpropenoic acid, maleic acid, maleic anhydride, fumaric acid, mesaconic acid, itaconic acid and citraconic acid maleic, fumaric, acrylic, methacrylic, itaconic, and citraconic acids, esters, and anhydrides (where possible). The esters may be represented by one of the formulae: $(R_1)_2C{=}C(R_1)C(O)OR_2$, or $R_2O{-}(O)C{-}HC{=}CH{-}C(O)OR_2$, wherein each $R_1$ and $R_2$ are independently hydrogen or a hydrocarbyl group having 1 to about 30, or to about 12, or to about 8 carbon atoms, $R_1$ is hydrogen or an alkyl group having from 1 to about 6 carbon atoms. In one embodiment, $R_1$ is preferably hydrogen or a methyl group. In another embodiment, $R_2$ is an alkyl or hydroxyalkyl group having from about 1 to about 30, or from 2 to about 24, or from about 3 to about 18 carbon atoms. $R_2$ may be derived from one or more alcohols described below. A number of unsaturated carboxylic esters are described below. Other examples of unsaturated carboxylic esters include ethyl maleate, butyl maleate and 2-ethylhexyl maleate. The above list includes mono- as well as diesters of maleic, fumaric, and itaconic acids and anhydrides. The polyalkene derivatives are prepared by means known to those in the art. These materials have been referred to as hydrocarbyl substituted carboxylic acylating agents, and are discussed below. U. S. Pat. Nos. 3,219,666 and 4,234,435 described the polyalkene derivatives and are incorporated for such descriptions.

In another embodiment, the polymer (A) is an ethylene-α-olefin copolymer. Typically, the copolymer is a random copolymer. The copolymer generally has from about 30% to about 80%, or from about 50% to about 75% by mole of ethylene. The α-olefins include butene, pentene, hexene or one more of the described above described α-olefins. In one embodiment, the α-olefin contains from about 3 to about 20, or from about 4 to about 12 carbon atoms.

In one embodiment, the polymer (A) is an ethylene propylene polymer. These polymers include ethylene propylene copolymers and ethylene propylene terpolymers. When the ethylene propylene polymer is an ethylene propylene copolymer (EPM, also called EPR polymers), it may be formed by copolymerization of ethylene and propylene under known conditions preferably Ziegler-Natta reaction conditions. The preferred ethylene propylene copolymers contain units derived from ethylene in an amount from about 40% to about 70%, or from about 50% to about 60%, or about 55% by mole, the remainder being derived from propylene. The molecular weight distribution may be characterized by a polydispersity ($\overline{M}w/\overline{M}n$) of less than about 15, preferably from about 1 to about 10, or from about 1.2 to about 4.

In another embodiment, the ethylene propylene polymer is a terpolymer of ethylene, propylene and a diene monomer. In one embodiment, the diene is a conjugated diene. The dienes include linear 1,3-conjugated dienes (e.g. 1,3-butadiene, 1,3-pentadiene, 3-methyl-1,3-butadiene, 2,3-dimethyl-1,3-butadiene, and 1,3-hexadiene) and cyclic dienes (e.g. cyclopentadiene, dicyclopentadiene, fulvene, 1,3-cyclohexadiene, 1,3,5-cycloheptatriene, and cyclooctatetraene), aliphatic dienes such as 1,4-pentadiene, 1,4-hexadiene, 1,5-hexadiene, 1,5-heptadiene, 2-methyl-1,4-pentadiene, 3-methyl-1,4-hexadiene, 4-methyl-1,4-hexadiene, 1,6-octadiene, 1,9-decadiene, and bicyclic dienes such as exo- and endo-dicyclopentadiene and the like; exo- and endo-alkenyl norbornenes, such as 5-propenyl-, 5-(butene-2-yl)-, and 5-(2-methylbuten-[2']-yl) norbornene and the like; alkyl alkenyl norbornenes such as 5-methyl-6-propenyl norbornene and the like; alkylidene norbornenes such as 5-methylene-2-norbornene, 5-ethylidene-2-norbornene, 5-iso-propylidene-2-norbornene, vinyl norbornene, cyclohexenyl norbornene and the like; alkyl norbornodienes such as methyl-, ethyl-, and propyl norbornodiene; and cyclodienes such as 1,5-cyclooctadiene, 1,4-cyclooctadiene, etc. Preferred dienes are cyclopendienes, especially dicyclopentadiene and alkylidene norbornenes, especially 5-ethylidene-2-norbornene. The terpolymers are produced under similar conditions as those of the ethylene propylene copolymers. The preferred terpolymers contain units derived from ethylene in amount from about 10% to about 90%, or from about 25% to about 85%, or from about 35% to about 60% by mole, and units derived from propylene in amount from about 15% to about 70%, or from about 30% to about 60% by mole, and units derived from diene third monomer in amount from about 0.5% to about 20%, or from about 1% to about 10%, or about 2% to about 8% by mole. The following table contains examples of ethylene propyl terpolymers.

| Example | Ethylene | Propylene | Diene |
|---|---|---|---|
| A | 42%* | 53% | 5% 1,5 heptadiene |
| B | 48% | 48% | 4% dicyclopentadiene |
| C | 45% | 45% | 10% 5-ethylidene-2-norbornene |
| D | 48% | 48% | 4% 1,6 octadiene |
| E | 48% | 48% | 4%, 4 cyclohexadiene |
| F | 50% | 45% | 4% 5-methylene-2-norbornene |

*Percentages are by mole

In one embodiment, the ethylene propylene polymer is a terpolymer of ethylene, propylene and dicyclopentadiene or ethylidene norbornene. The ethylene propylene polymers are prepared by means know to those in the art. U.S. Pat. No. 3,691,078 describes ethylene propylene polymers and methods of preparing them. The patent is incorporated by reference for such disclosures.

In another embodiment, the polymer (A) is a copolymer of an α-olefin and an unsaturated reagent, such as the above described unsaturated carboxylic reagents. The α-olefins may be any of those discussed above, and include propylene, 1-butene, 2-methyl propene, 2-methyl-1-octene, and 1-decene. The unsaturated reagents include acrylate, methacrylate, maleate and fumates, and are described above. The α-olefin-unsaturated carboxylic reagent polymers are prepared by means known to those in the art. Examples of α-olefin-unsaturated carboxylic reagent copolymers include poly(octene-co-ethylacrylate), poly(decene-co-butylmethacrylate), poly(hexene-co-maleic anhydride), poly (octene-co-methyl fumarate) and the like.

In another embodiment, the polymer (A) is a polyacrylate or polymethacrylate having a $\overline{M}w$ of less than about 10,000. The polyacrylates and polymethacrylates include homopolymers and interpolymers of one or more acrylic or methacrylic acids or esters. The esters may be one or more of those represented by the above formula (unsaturated carboxylic esters). Examples of unsaturated carboxylic esters include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2-hydroxypropyl acrylate, etc. They are prepared by means known to those in the art, such as by free radicle polymerization.

In another embodiment, the polymer (A) is a hydrogenated interpolymer of an vinyl substituted aromatic compound and a conjugated diene. The interpolymers include diblock, triblock and random block interpolymers. The vinyl substituted aromatic compounds generally have from about 8 to about 20, or from about 8 to about 18, or from about 8 to about 12 carbon atoms. Examples of vinyl substituted aromatics include styrene, α-methylstyrene, o-methylstyrene, m-methylstyrene, p-methylstyrene, p-t-butylstyrene, with styrene being preferred. The conjugated dienes are described above. Isoprene and 1,3-butadiene are preferred conjugated dienes.

The vinyl substituted aromatic content of these copolymers is in the range from about 20% to about 70%, or from about 40% to about 60% by weight. Thus, the conjugated diene content is in the range from about 30% to about 80%, or from about 40% to about 60% by weight. These interpolymers are prepared by conventional methods well known in the art. Such copolymers usually are prepared by anionic polymerization using, for example, an alkali metal hydrocarbon (e.g., sec-butyllithium) as a polymerization catalyst.

Polymer (B)

The lubricating compositions generally have from about 2% to about 12%, from about 3% to about 10%, or from about 4% to about 8% by weight of (B) a polymer having a $\overline{M}w$ of greater than 15,000. In one embodiment, the polymer (B) has a $\overline{M}w$ up to about 50,000, or up to about 45,000, or up to about 40,000. The polymer (b) typically has a $\overline{M}w$ of at least about 15,000, or at least about 17,000, or at least about 19,000. The polymers include a polyalkene or derivative thereof, an ethylene-α-olefin copolymer, an ethylene-propylene polymer, an α-olefin-unsaturated reagent copolymer, a polyacrylate, a polymethacrylate, a hydrogenated interpolymer of a vinyl substituted aromatic compound and a conjugated diene, and mixtures thereof.

In one embodiment, the polymer (B) is a polyalkene having a $\overline{M}w$ greater than 15,000. The polyalkenes and their components are described above. These polymers include commercially available polyalkenes, such as polybutenes. In another embodiment, the polyalkene is derived from at least one diene. An example of a polyalkene derived from a diene is LIR-290, a hydrogenated polyisoprene ($\overline{M}w$=25,000) available commercially from Kuraray Co, Ltd.

In another embodiment, the polymer (B) has a kinematic viscosity of at least about 150, or about 175 cSt at 100° C. The polymer (B) typically has a kinematic viscosity from about 150 to about 6000, or from about 175 to about 5000 cSt at 100° C. In one embodiment, polymer (B) has a kinematic viscosity from about 150 to about 500, or from about 175 to about 400 cSt at 100° C.

In one embodiment, the polymer (B) is a polyalkene derived from one or more of the α-olefins described above. Generally, this polymer has a kinematic viscosity from about 150 to about 700, or from about 160 to about 600, or from about 170 to about 500 cSt at 100° C. These polyalkenes are typically liquids at room temperature (i.e. 22° C.) and have a Brookfield viscosity of less than 150,000 cps at −40° C. The polyalkene generally has a weight average molecular weight from about 15,000 to about 30,000, or from about 17,000 to about 27,000, or from about 20,000 to about 26,000. In another embodiment, the polyalkene has a number average molecular weight ($\overline{M}n$) of 2,000 to about 100,000. In one embodiment, the polyalkene has a polymodal distribution with peak molecular weight maximums at 2,000 to 5,000 and at 50,000 to 75,000. The products obtained herein typically contain a polymodal molecular weight distribution and are primary bimodal. The modal distribution of the polymers indicates that there are peak molecular weight maximums at more than one point in the distribution of the molecular weight of the polymer. In one embodiment, the peak molecular weight maximums are from 3,500 to 4,500 and from 55,000 to 65,000. The weight ratio of the lower molecular weight component to the higher molecular weight component is typically 95:5 to 70:30, and preferably 90:10 to 80:20.

The polyalkene is prepared by the process comprising the steps of contacting at least one α-olefin, such as those discussed above, with a catalyst system comprising an organo halide and a Lewis acid catalyst under polymerization conditions and obtaining the α-olefin polymer. The organic halide may be a primary, secondary or tertiary organic halide. In one embodiment, the polymer is substantially free of aromatic content. The desired monomers are normal or linear. The polymers may be homopolymers, copolymers or terpolymers.

In one embodiment, the polyalkenes are prepared from mixtures of α-olefins. For example the polyalkene may be prepared from mixtures of the normal α-olefins, such as octene and dodecene; heptene and nonene; hexene and decene; and octene and tetradecene; ternary mixtures such as the normal octene, dodecene and hexadecene; and a ternary mixture of the normal octene, dodecene and tetradecene. Where binary mixtures of two α-olefins are utilized, they are typically present at from 5% to 95%, preferably 10% to 90% by weight of each of the α-olefins. Where ternary mixtures are employed, each of the α-olefins will be utilized at from about 5% to about 90%, preferably about 10% to about 70% of each of the monomers.

The catalysts employed herein are a first catalyst system comprising a tertiary organo halide and a second system employing a Lewis acid catalyst. The organo halides are represented by the general formula $$R_1R_2R_3CX$$

wherein X is a halogen and $R_1$ is a hydrocarbyl group, $R_2$ and $R_3$ are each independently hydrogen or a hydrocarbyl group. The value of X as a halogen may be any of the typically employed halogen atoms, e.g., fluorine, chlorine, bromine or iodine, preferably chlorine or bromine, more preferably chlorine. $R_1$ through $R_3$ may be the same or different hydrocarbyl groups, provided that the heteroatoms within the hydrocarbyl groups, if present, are not deleterious to the catalyst. In one embodiment, $R_1$ through $R_3$ are alkyl groups. In another embodiment, $R_1$ through $R_3$ are straight chained or normal hydrocarbyl groups. Generally, each one of $R_1$ through $R_3$ independently contain from 1 to about 12, or from about 3 to about 10, or to about 8 carbon atoms. In one embodiment, the total number of carbon atoms in the organo halide is from about 4 to about 12 carbon atoms. Examples of useful organo halides include n-propyl halides, n-butyl halides, n-pentyl halides, n-hexyl halides, sec-propyl halides, sec-butyl halides, sec-hexyl halide, t-butyl chloride and t-amyl chloride.

The second catalyst is a Lewis acid catalyst. Specific examples of Lewis acid catalysts useful in the present invention include boron trifluoride, aluminum halides such as aluminum chloride, aluminum monochlorodibromide, aluminum bromide and aluminum monobromodichloride.

An aprotic solvent is typically utilized in preparing the polyalkene. The solvent is a normally liquid material at 20° C. The solvent may be a hydrocarbon or a halogenated hydrocarbon. The solvent typically contains from 1 to about 12, or from 1 to about 8, or from about 3 to about 8 carbon atoms. Typically, the solvent include butane, pentane, cyclopentane, hexane, cyclohexane, methylene chloride, monobromo,monochloromethane, methylenebromide, 1,2-dichloroethane, 1,1-dibromocyclopropane 1,1-dichlorocyclopropane, cis 1,2-dichlorocyclopropane, trans 1,2-dichlorocyclopropane, cis 1,2-dibromocyclopropane, trans 1,2-dibromocyclo-propane, carbon tetrachloride and geminal dihalo compounds, such as ethylene dichloride and methylene chloride.

In one embodiment, the polymerization reaction is performed in the presence of an activating amount of a protic compound. Typically, the protic compound is water. The term activating amount as later discussed means that amount which promotes the overall polymerization reaction and is not such an amount as to substantially decrease the polymerization reaction or to inactivate the catalyst system. An activating amount of the protic compound is typically less than 1%, preferably 0.0001% to 0.1%, by weight of the catalyst system. After the polymerization is substantially complete, the catalyst system may be deactivated through the use of excess amounts of water or methanol. The product is typically recovered by treating the reaction mixture with a drying agent such as magnesium sulfate followed by filtration and solvent stripping to yield the neat liquid polymer.

The organo halide catalyst and the Lewis acid catalyst are typically employed such that the final amount of each material present in the reaction mixture on a molar basis is about 1.0:0.1 to about 0.1:1.0, respectively. More preferably, the molar ratio of the catalysts is from about 5:1 to about 1:5, most preferably 2:1 to 1:2. The Lewis acid catalyst may be added incrementally, however, the use of all of the catalyst at once is recommended. The amount of the aprotic solvent, if any, utilized in relation to the Lewis acid catalyst on a molar basis is typically about 100:1 to about 1:1, more preferably about 75:1 to about 2:1, most preferably about 50:1 to about 5:1.

The total α-olefin monomer charge to the Lewis acid catalyst is typically about 150:1 to about 10:1 preferably from about 75:1 to about 20:1 on a weight basis. The suggested amounts of the α-olefin monomer to the tertiary organo halide catalyst may thus be derived from the foregoing ratios.

The following example relate to preparation of polyalkenes. Unless the context indicates otherwise, the amounts are by weight, the temperature is Celsius and the pressure is atmospheric.

EXAMPLE I

A reaction vessel is equipped with a stirrer, addition funnel, thermometer, condenser and a cooling bath. A solution of 1000 g (8.93 moles) 1-octene, 1000 g (5.95 moles) 1-dodecene and 40.0 g (0.375 moles) tertary amyl chloride is prepared and charged to the additional funnel. To the reactor is charged 1000 ml. dry methylene chloride and 50.0 g anhydrous $AlCl_3$. A $N_2$ atmosphere is maintained throughout the polymerization procedure. The stirred $AlCl_3$ slurry is cooled to 5° C., whereupon a dropwise addition of the comonomer/t-butyl chloride solution is initiated and continued over 1.25 hours into the reactor. The polymerization temperature is maintained between 5°–10° C. After the comonomer/t-butyl chloride charge is complete, the polymerization mixture is stirred for an additional 1.5 hours at 5°–10° C.

The polymerization mixture is warmed to room temperature with stirring. The catalyst is neutralized by adding a water/methanol solution dropwise. The product is then dried by $Na_2SO_4$, filtered and the solvent removed to give a 90% yield of a liquid 1-olefin copolymer having a bulk viscosity at 100° C. of 250 cSt. Gel permeation chromatography (polyisobutylene standard) indicates a $\overline{M}n$=4000, $\overline{M}w$=25000.

EXAMPLE II

A solution of 300 g (2.68 moles), 300 g (1.79 moles) 1-dodecene and 5.2 g (0.056 mole) secondary butyl chloride is charged to an addition funnel on a reaction vessel. The reaction vessel is charged with 300 ml of dry methylene chloride and 12.0 g (0.090 mole) of anhydrous $AlCl_3$. An $N_2$ atmosphere is maintained throughout the polymerization. The stirred $AlCl_3$slurry is cooled to 23° C., whereupon a dropwise addition of the comonomer/secondary butyl chloride solution is initiated and continued over 2 hours. The polymerization temperature is maintained at 23° C. plus or minus 1° C. After addition of the comonomer/secondary butyl chloride solution, the product mixture is stirred for an additional two hours at 23° C. plus or minus 1° C.

The catalyst is neutralized by adding a 22% by weight of aqueous sodium hydroxide solution. After neutralization, the aqueous and organic phases are separated. The organic phase is stripped of solvent at 150° C. and 10 mm Hg vacuum (1.33 KPa). The organic phase is then filtered to give a 92% yield of a liquid copolymer having a bulk viscosity at 100° C. of 324 cSt and chloride content of 0.013% by weight. Gel permeation chromatography (polyisobutylene standard) indicates a $\overline{M}n$=4400 and $\overline{M}w$=23400.

The above polyalkenes and methods of making the same are described in U.S. Pat. No. 4,968,853, issued to Scharf, and U.S. Pat. No. 5,210,362, issued to Sowerby et al. These patents are incorporated by reference for such disclosure.

In another embodiment, polymer (B) is an ethylene propylene polymer. The ethylene propylene polymers are described above. In one aspect, the ethylene propylene polymer is a terpolymer of ethylene, propylene and dicyclopentadiene or ethylidene norbornene available commercially as Trilene elastomers from the Uniroyal Corporation. A useful ethylene propylene terpolymer is Trilene CP-40.

In another embodiment, polymer (B) is an ethylene α-olefin copolymer. The ethylene α-olefin copolymers are described above. The ethylene-α-olefin copolymers have a $\overline{M}w$ from about 10,000 up to about 40,000, or from about 15,000 to about 35,000, or from about 20,000 up to about 30,000. In another embodiment, the ethylene-α-olefin copolymers have a $\overline{M}n$ from about 800 to about 6000, or from about 1500 to about 5000, or from about 2000 to about 4500. Examples of ethylene α-olefins copolymers include ethylene-butene copolymers and ethylene-octene copolymers. Examples of commercially available copolymers include Lucant HC 600 and Lucant HC 2000 available from Mitsui Petrochemical Co.,Ltd.

In another embodiment, polymer (B) is a polyacrylate or polymethacrylate. These polymers are described above. The polyacrylates and polymethacrylates include the Acryloid 1019 polymers, available from Rohm and Haas Company and Viscoplex 0-101, available from Rohm Darmstadt.

In another embodiment, polymer (B) is a hydrogenated copolymer of a vinyl substitued aromatic compound and a diene. The copolymers are described above. Examples of suitable hydrogenated copolymers of a vinyl substituted aromatic compound and a conjugated diene include Shellvis-40, and Shellvis-50, both hydrogenated styrene-isoprene block copolymers, manufactured by Shell Chemicals.

Fluidizing Agents (C)

The lubricating compositions additionally contain (C) at least one fluidizing agent. The fluidizing agent, when combined with the polymers (A) and (B) provides the viscosity requirements of the lubricating compositions. Generally, the fluidizing agent (C) is present in an amount up to about 30% by weight. In one embodiment, it is provided that when the fluidizing agent is a polyα-olefin having a kinematic viscosity from about 2 to about 30 cSt at 100° C., then the polyα-olefin is present in an amount up to about 12% by weight. Typically the fluidizing agent is present in an amount from about 10% to about 28%, or from about 15% to about 25% by weight of the lubricating composition. The amount of fluidizing agent equals the total amount of fluidizing agent in the lubricating compositions.

In one embodiment, the fluidizing agent (C) is at least one member selected from the group consisting of an alkylated aromatic hydrocarbon, a naphthenic oil, a polyα-olefin having a kinematic viscosity from about 3 to about 20 cSt at 100° C., a carboxylic acid esters, and mixtures of two or more thereof. The alkylated aromatic hydrocarbons typically include mono- or di- (more preferably mono-) substituted benzenes wherein the substituents are hydrocarbon-based groups having from about 8 to about 30, or from about 10 to about 14 carbon atoms. An example is Alkylate A-215 (a 237 molecular weight alkylated benzene) and Alkylate A-230 (a 230 molecular weight alkylated benzene) available from Monsanto.

The naphthenic oils are those derived from naphthenic crudes such as found in the Louisiana area. The viscosity of such naphthenic oils at 40° C. generally is less than 4 centistokes and more generally within the range from about 3.0 to about 3.8 centistokes. At 100° C. the viscosity of the desirable naphthenic crudes is within the range of about 0.8 to about 1.6 centistokes.

The polyα-olefins (PAOs) are derived from monomers having from about 4 to about 30, or from about 4 to about 20, or from about 6 to about 16 carbon atoms. Examples of useful PAOs include those derived from one or more of the above olefins, such as the α-olefins. These PAOs may have a viscosity from about 3 to about 150, or from about 4 to about 100, or from about 4 to about 8 cSt at 100° C. A particularly useful PAO is derived from decene. Examples of PAOs include 4 cSt polyα-olefins, 6 cSt polyα-olefins, 40 cSt polyα-olefins and 100 cSt polyα-olefins.

The carboxylic ester fluidizing agents are reaction products of dicarboxylic esters with alcohols having from about 1 to about 30, or from about 2 to about 18, or from about 3 to about 12 carbon atoms. The alcohols are described below and include methyl, ethyl, propyl, butyl, hexyl, heptyl, octyl, decyl and dodecyl alcohols. The dicarboxylic acids generally contain from about 4 to about 18, or from about 4 to about 12, or from about 4 to about 8 carbon atoms. Examples of dicarboxylic acids include phthalic acid, succinic acid, alkyl ($C_{1-24}$)succinic acids, azelaic acid, adipic acid, and malonic acid. Examples of such oils include the esters of dicarboxylic acids (e.g., phthalic acid, succinic acid, alkyl succinic acids, azelaic acid, adipic acid, and malonic acid) with a variety of alcohols including, for example, butyl alcohol, dodecyl alcohol, etc. Particularly useful esters are dicarboxylic esters of $C_{1-12}$ alcohols, such as esters of propyl, butyl, pentyl, hexyl, and octyl alcohols and azelaic acid. In one embodiment, the lubricating compositions contain less than about 20% or less than about 15% by weight of a carboxylic ester fluidizing agent.

In one embodiment, the lubricating compositions and concentrates include (D) at least one antiwear or extreme pressure agent. The antiwear or extreme pressure agent generally is present in amounts from about 0.05% to about 10%, or from about 0.1% to about 8%, or from about 0.3% to about 7%, or from about 0.5% to about 5% by weight. In one embodiment, (D) is used in crankcase lubricants in an amount from about 0.05% to about 6%, or preferably from about 0.1% to about 4% by weight. In another embodiment, (D) is used in a driveline or transmission fluid, in an amount from about 0.5% to about 10%, preferably from about 1% to about 7%, or from about 2% to about 6% by weight. When (D) is a mixture of components, such as a sulfur antiwear or extreme pressure agent and a phosphorus antiwear agent, then each component may be independently present in the amounts given above. In one embodiment, (D) is at least one member selected from the group consisting of a sulfur compound, a phosphorus containing compound, a boron contaning compound, and mixtures of two or more thereof.

Sulfur Compounds (D)

The sulfur containing antiwear and/or extreme pressure agents (D) include sulfrized compounds, such as sulfurized olefins, metal and ashless dithiocarbamates, or mixtures of two or more thereof. The sulfur compounds include mono- or polysulfide compositions, and mixtures of mono and polysulfide. The sulfur compounds are generally characterized as having sulfide linkages contaning an average from 1 to about 10, or from about 2 to about 8, or from about 3 to about 4 sulfur atoms. In one embodiment, the sulfur compound may be a mixture of di-, tri- or tetrasulfide materials, preferably having a majority of trisulfide. Materials having at least 70% trisulfide are preferred, with materials containing greater than 80% trisulfide more preferred.

The sulfur containing antiwear and/or extreme pressure agent (D) includes sulfurized compounds, such as sulfrized olefins, metal containing and ashless dithiocarbamates, or mixtures of two or more thereof. The sulfur compounds include mono- or polysulfide compositions, and mixtures of mono and polysulfide compositions. Materials which may be sulfurized to form the sulfur compounds include oils, unsaturated fatty acids, unsaturated fatty esters, olefins, terpenes, or Diels-Alder adducts. Oils which may be sulfurized are mineral or synthetic oils, including mineral oils, lard oil, carboxylic acid esters derived from aliphatic alcohols and fatty acids or aliphatic carboxylic acids (e.g., myristyl oleate and oleyl oleate), and synthetic sperm whale oil substitutes and synthetic unsaturated esters or glycerides. U.S. Pat. Nos. 3,926,822 and 3,955,347, both issued to Habiby teach oils and sulfurized products may therefrom. These patents are incorporated by reference.

The unsaturated fatty acids generally contain from about 8 to about 30, or from about 12 to about 24 carbon atoms. Examples of unsaturated fatty acids include palmitoleic acid, oleic acid, linoleic acid, linolenic acid, erucic acid, lard oil acid, soybean oil acid, tall oil acid and rosin acid. The unsaturated fatty esters include fatty oils, that is, naturally occurring or synthetic esters of glycerol and one or more of the above unsaturated fatty acids. Examples of fatty esters include animal fats, such as Neat's-foot oil, lard oil, depot fat, beef tallow, vegetable oils such as cottonseed oil, corn oil, safflower oil, sesame oil, soybean oil, and sunflower seed oil. The unsaturated fatty esters also may be prepared by esterifying a fatty acid with alcohols and polyols. The alcohols include mono- and polyhydric alcohols, such as methanol, ethanol, propanol, butanol, ethylene glycol, neopentyl glycol, glycerol and others described below.

The olefins, which may be sulfurized, contain at least one olefinic double bond, which is defined as a non-aromatic double bond. The olefins include the olefins and the dienes described above for preparing the polyalkenes. In its broadest sense, the olefin may be defined by the formula $R^{*1}R^{*2}C{=}CR^{*3}R^{*4}$, wherein each of $R^{*1}$, $R^{*2}$, $R^{*3}$, and $R^{*4}$ is hydrogen, or an organic group. In general, the R* groups in the above formula which are not hydrogen may be represented by $-(CH_2)_n-A$, wherein n is a number from 0 to about 10 and A is represented by $-C(R^{*5})_3$, $-COOR^{*5}$, $-CON(R^{*5})_2$, $-COON(R^{*5})_4$, —COOM, —CN, —X, $-YR^{*5}$ or —Ar, wherein: each $R^{*5}$ is independently hydrogen, or a hydrocarbyl group, with the proviso that any two $R^{*5}$ groups may be connected to form a ring of up to about 12 carbon atoms; M is one equivalent of a metal cation (preferably Group I or II, e.g., sodium, potassium, barium, or calcium); X is halogen (e.g., chloro, bromo, or iodo); Y is oxygen or divalent sulfur; Ar is an aromatic group of up to about 12 carbon atoms.

The olefinic compound is usually one in which each R group which is not hydrogen is independently alkyl, alkenyl or aryl group. In one embodiment, $R^{*3}$ and $R^{*4}$ are hydrogen and $R^{*1}$ and $R^{*2}$ are alkyl or aryl, especially alkyl having from 1 to about 30, or to about 16, or to about 8, or to about 4 carbon atoms. Olefins having from 2 to about 30, or from about 3 to about 16 (most often less than about 9) carbon atoms are particularly useful. Olefins having from 2 to about 5, or from 2 to about 4 carbon atoms are particularly useful. Isobutene, propylene and their dimers, trimers and tetramers, and mixtures thereof are especially preferred olefins. Of these compounds, isobutylene and diisobutylene are particularly desirable. The sulfur compound may be prepared by the sulfochlorination of olefins containing four or more carbon atoms and further treatment with inorganic higher polysulfides according to U.S. Pat. No. 2,708,199. In another embodiment, the sulfur compounds may be produced by sulfochlorination olefins, and further treatment with an alkali metal sulfide in the presence of free sulfur, and finally reacting that product with an inorganic base. This procedure is described in U.S. Pat. No. 3,471,404, and this disclosure is hereby incorporated by reference for its discussion of this procedure for preparing sulfurized olefins and the sulfurized olefins thus produced.

In one embodiment, the sulfur compound is an organic polysulfide. The sulfur compound may also be prepared by reacting, under superatmospheric pressure, the olefin with a mixture of sulfur and hydrogen sulfide in the presence, or absence, of a catalyst, followed by removal of low boiling materials. The olefins which may be sulfurized, the sulfurized olefin, and methods of preparing the same are described in U.S. Pat. Nos. 4,119,549, 4,199,550, 4,191,659, and 4,344,854. The disclosure of these patents is hereby incorporated by reference for its description of the sulfurized olefins and preparation of the same.

In one embodiment, the organic polysulfide is a mixture comprising at least about 90% dihydrocarbyl trisulfide, from about 0.1%, or from about 0.5% to about 8% dihydrocarbyl disulfide, and less than about 5% dihydrocarbyl higher polysulfides. Higher polysulfides are defined as containing four or more sulfide linkages. In one embodiment, the amount of trisulfide is at least about 92%, or preferably at least about 93%. In another embodiment, the amount of dihydrocarbyl higher polysulfides is less than 4%, or preferably less than about 3%. In one embodiment, the dihydrocarbyl disulfide is present in an amount from about 0.1%, or from about 0.5% to about 5%, or from about 0.6% to about 3%.

The sulfide analysis is performed on a Varian 6000 Gas Chromatograph and FID detector SP-4100 computing integrator. The Column is a 25 m. Megabore SGE BP-1. The temperature profile is 75° C., hold 2 min., to 250° C. at 6° C./min. The helium flow is 6.0 ml/min plus make-up. The injection temperature is 200° C. and the detector temperature is 260° C. The injection size is 0.6 ul. References are the monosulfide, disulfide and trisulfide analogues to the sulfur composition for analysis. The references may be obtained by fractionating the product to form sulfide fractions (S1, S2 and S3) to be used for analysis. The procedure for analysis is as follows. (1) An area % determination is run on each of the reference samples to determine its purity. (2) An area % determination is run on the sample to be tested to get a general idea of its composition. (3) A calibration blend is accurately weighed based on the area % results of the sample to be tested: then the internal standard toluene, is added to the blend in an amount equal to approximately one-half of the weight of the largest component. (This should give an area approximately the same as that of the largest component.) (4) The weights of each component (i.e., S-1, S-2 and S-3) are corrected by the % purity from step 1. (5) The calibration blend is run in triplicate using the corrected weights and then calculated, using the following formula, to reflect the multiple peaks in S-1 and S-2:

$$RF = \frac{\text{(concentration of components*)}}{\text{(total area of peaks)}} \quad \frac{\text{(area of internal standard)}}{\text{(concentration of internal standard)}}$$

* Adjusted for purity of the standard i.e.: component weight times percent purity equals concentration of componont.

(6) These response factors, plus the response factor for the single S-3 peak are used for determining weight percent results for the samples to be tested. (7) Results for S-1 and S-2 are adjusted to include all the peaks attributed to them. (8) Higher polysulfides are determined by difference using the following formula:

$$S\text{-}4 = 100\% - (S\text{-}1 + S\text{-}2 + S\text{-}3 + \text{light ends})$$

Light ends are defined as any peaks eluded prior to the internal standard.

In one embodiment, the sulfur compound is prepared by reacting, optionally under superatmospheric pressure, one or more of the above olefins with a mixture of sulfur and hydrogen sulfide in the presence, or absence, of a catalyst, such as an alkylamine catalyst, followed by removal of low boiling materials. The olefins which may be sulfurized, the sulfurized olefin, and methods of preparing the same are described in U.S. Pat. Nos. 4,119,549, 4,199,550, 4,191,659, and 4,344,854. The disclosure of these patents is hereby incorporated by reference for its description of the sulfurized olefins and preparation of the same. The polysulfide thus produced is fractionally distilled. In one aspect, the fractional distillation occurs under subatmospheric pressure. Typically the distillation pressure is from about 1 to about 250, from about 1 to about 100, or from about 1 to about 25 mm Hg. A fractionation column such as Snyder fractionation column may be used. In one embodiment, the fractionation is carried out at a reflux ratio from about 1:1 to about 15:1, or from about 2:1 to about 10:1, or from about 3:1 to about 8:1. The fraction distillation occurs at a temperature at which the sulfur composition which is being fractionated boils. Typically the fractional distillation occurs at a pot temperature from about 75° C. to about 300° C., or from about 90° C. to about 200° C.

The conditions of fractional distillation are determined by the sulfur composition being distilled. Typically, the sulfur compound is heated to a temperature at which boiling occurs. The distillation system is brought to equilibrium and the distillation commences with a chosen reflux ratio. The fractions obtained from the distillation are removed from the distillation apparatus. The amount of the desired fraction may be calculated by determining the proportion of sulfides. The desired fraction is obtained by maintaining accurate temperature control on the distillation system. The boiling fractions are removed at a specific vapor and temperature for that fraction. The reflux ratio is adjusted to maintain the temperature at which this fraction boils. After removal of the desired fraction, the fraction may be further filtered as desired.

In general, fractionation is carried out in a continuous or a batch process. In a continuous process, the material to be fractionated is fed to a fractionating column. Parameters are controlled in the system, such as feed flow, temperatures throughout the column, and the reflux ratio, etc., to separate the components in the feed into an overhead and bottoms stream. These parameters are adjusted to maintain the desired composition in the overhead and bottoms streams.

For a batch process, the material to be fractionated is charged to a vessel and is heated to boiling temperatures with agitation. Once the material reaches the boiling point, the fractionation column system is brought to equilibrium. Subsequently, the desired reflux ratio is set. Collection of the distillate is commenced, as described herein. The reflux ratio is increased as is necessary to maintain the appropriate temperatures in the fractionating column system. As the distillation rate slows, the reflux ratio is increased until eventually the collection of the distillate stops. The different fractions are separated as the above process is repeated at higher temperatures.

The following examples relate to sulfurized olefins. Unless the context clearly indicates otherwise, here, as well as throughout the specification and claims, the amounts are by weight, the temperature is in degrees Celsius and the pressure is atmospheric.

EXAMPLE S-1

Sulfur (526 parts, 16.4 moles) is charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid. The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

EXAMPLE S-2

Sulfur monochloride (2025 grams, 15.0 moles) is heated to 45° C. Through a sub-surface gas sparge, 1468 grams (26.2 moles) of isobutylene gas are fed into the reactor over a 5-hour period. The temperature is maintained between 45°–50° C. At the end of the sparging, the reaction mixture increases in weight to 1352 grams. In a separate reaction vessel are added 2150 grams (16.5 moles) of 60% flake sodium sulfide, 240 grams (7.5 moles) sulfur, and a solution of 420 ml. of isopropanol in 4000 ml. of water. The contents are heated to 40° C. The adduct of the sulfur monochloride and isobutylene previously prepared is added over a three-quarter hour period while permitting the temperature to rise to 75° C. The reaction mixture is heated to reflux for 6 hours, and afterward the mixture is permitted to form into separate layers. The lower aqueous layer is discarded. The upper organic layer is mixed with two liters of 10% aqueous sodium hydroxide, and the mixture is heated to reflux for 6 hours. The organic layer is again removed and washed with one liter of water. The washed product is dried by heating at 90° C. and 30 mm. Hg. pressure for 30 minutes. The residue is filtered through diatomaceous earth filter aid to give 2070 grams of a clear yellow-orange liquid.

EXAMPLE S-3

The product of Example S-1 (1000 lbs.) is charged to a reactor, under medium agitation, and heat to approximately 88° C.–94° C. The reaction mixture is brought to equilibrium and the equilibrium is maintained for 30 minutes prior to collection of distillate. The reflux ratio is set at 4:1. The temperature is raised to 105° C. to ensure a steady distillation rate. Distillation is continued for approximately 20–24 hours and yields approximately 230–260 lbs. The temperature is raised to 105° C.–107° C. The system is brought to equilibrium and the equilibrium is maintained for 30 minutes prior to collection of distillate. The reflux ratio is set at 4:1. The temperature is raised to 121° C.–124° C., in order to ensure a steady distillation rate. The distillate is collected over 75–100 hours. The distillation yields approximately 300–400 lbs. of the desired product. The desired product contains 2–5% S2, 91–95% S3, and 1–2% S4.

EXAMPLE S-4

In a vessel with a fractionation column, the product of Example S-1 (10,000 grams) is brought to a boil, approximately 200° F., under medium agitation. The column is brought to equilibrium by regulating the vapor temperature. The equilibrium is maintained for 30 minutes prior to collection of distillate. The reflux ratio is set at 5:1. Under these conditions, the distillate is collected until the accumulation of distillate is less than 5 ml in 15 minutes. The distillate (100 ml, 88 grams) is collected at a vapor temperature of 56° C. The temperature of the vessel is raised 15° F. An additional aliquot of 50 grams of distillate is removed, at a vapor temperature of 58° C. Distillate (1863) is collected and is removed. The collection is continued as long as the distillate rate stays greater than 5 ml/15 minutes. If boiling drops off, the temperature of the vessel is raised 5.5° C. Collection of distillate is continued until the distillation rate is less than 5 ml/15 minutes. The distillate contains approximately 473 grams of desired product. For the final collection of distillate, the temperature of the vessel is raised 9° C. to 116° C., not exceeding 121° C. Distillate (220 ml, 214 grams) is removed at a vapor temperature of 69° C. Collection of the remainder of the distillate (4114 grams) is continued until the distillation rate is less than 5 ml/15 minutes. A yield after fractionation should approximate 6777 grams of the desired product. The desired product contains approximately 2% S2, 95.6% S3, and 0.15% S4.

In another embodiment, the sulfur compound is a sulfrized terpene compound. The term "terpene compound" as used in the specification and claims is intended to include the various terpene hydrocarbons, such as contained in turpentine, pine oil and dipentenes, and the various synthetic and naturally occurring oxygen-containing derivatives. Pine-oil derivatives, which are commercially available from Hercules Incorporated, include α-terpineol (a high purity tertiary terpene alcohol); and Terpineol 318 Prime (a mixture containing about 60–65% weight α-terpineol and 15–20% weight beta-terpineol); Yarmor 302; Herco pine oil; Yarmor 302W; Yarmor F; and Yarmor 60.

In another embodiment, the sulfur compound is a sulfurized Diels-Alder adduct. The sulfrized Diels-Alder adduct is prepared by reacting a sulfur source, such as elemental sulfur, sulfur halides and organic polysulfides, including dialkyl polysulfides with a Diels-Alder adduct. A Diels-Alder reaction involves the reaction of one or more of the above conjugated dienes with one or more ethylenically or acetylenically unsaturated compounds, these latter compounds being known as dienophiles.

Dienophiles include nitroalkenes; α, β-ethylenically unsaturated carboxylic esters, acids or amides; ethylenically unsaturated aldehydes and vinyl ketones. The unsaturated carboxylic esters, acids and amides are described above. Specific examples of dienophiles include 1-nitrobutene-1-alkylacrylates, acrylamide, N,N'-dibutylacrylamide, methacrylamide, crotonaldehyde; crotonic acid, dimethyl divinyl ketone, methyl vinyl ketone, propiolaldehyde, methyl ethynyl ketone, propiolic acid, propargylaldehyde, cyclopentenedione, 3-cyanocoumaran, etc.

The sulfurized Diels-Alder adducts are prepared by means known to those in the art. Generally, the molar ratio of sulfur source to Diels-Alder adduct is in a range of from about 0.75 to about 4, or from about 1 to about 3, or to about 2.5. An example of a useful sulfurized Diels-Alder adduct is a sulfurized Diels-Alder adduct of butadiene and butylacrylate. Sulfurized Diels-Alder adducts, their intermediate components and methods of preparing them are described in U.S. Pat. Nos. 3,498,915, 4,582,618, and Re 27,331. These patents are hereby incorporated by reference for their disclosures of sulfurized Diels-Alder adducts, intermediate components and methods of making the same.

In another embodiment, the sulfur compound is a metal containing or ashless dithiocarbamate. The metal-containing dithiocarbamates are prepared reacting a dithiocarbamic acid with a metal base. The metal base may be any metal compound capable of forming a metal salt. Examples of metal bases include metal oxides, hydroxides, carbonates, borates, or the like. The metals of the metal base include Group IA, IIA, IB through VIIB, and VIII metals (CAS version of the Periodic Table of the Elements). These metals include the alkali metals, alkaline earth metals, and transition metals. In one embodiment, the metal is a Group IIA metal, such as calcium or magnesium, a Group IB metal, such as copper, a Group IIBB metal, such as zinc, or a Group VIIB metal, such as manganese. Preferably the metal is magnesium, calcium, copper, or zinc. Examples of metal compounds which may be reacted with the phosphorus acid include zinc hydroxide, zinc oxide, copper hydroxide, copper oxide, etc. Examples of metal containing dithiocarbamates zinc diamyldithiocarbamate, zinc di(2-ethylhexyl) dithiocarbamate, magnesium dibutyldithiocarbamate, magnesium dioctyldithiocarbamate, sodium diamyldithiocarbamate, and sodium diisopropyl dithiocarbamates. The metal dithiocarbamates and their preparation are described in U.S. Pat. No. 4,612,129, which is incorporated by reference.

In another embodiment, the sulfur compound is an ashless dithiocarbamate. The ashless dithiocarbamate may be an amine salt of a dithiocarbamic acid and one or more of the amines described below. The dithiocarbamate compositions include reaction products of a dithiocarbamic acids or salts and an unsaturated amide, carboxylic acid, anhydride, or ester, or ether, alkylene-coupled dithiocarbamate, bis(S-alkyldithiocarbamoyl)disulfides and mixtures of two or more thereof. The dithiocarbamate compositions may also be prepared by simultaneously reacting an amine, carbon disulfide and an unsaturated compound. U.S. Pat. Nos. 4,758,362 and 4,997,969 describe dithiocarbamate compositions and methods of making the same. These patents are hereby incorporated by reference for their disclosure of dithiocarbamate compositions and method of making the same.

The dithiocarbamic acid or salt used to prepare the dithiocarbamate compositions are prepared by reacting an amine with carbon disulfide. The amines may be primary or secondary amines, with secondary amines most preferred. The amines generally contain hydrocarbyl groups. Each hydrocarbyl group may independently contain from one to about 40, or from about two to about 30, or from three to about 24, or even to about 12 carbon atoms. Examples of groups, which may be on the amines, include ethyl, propyl, butyl, hexyl, octyl and dodecyl groups.

In one embodiment, the amines are primary amines, including fatty primary amines, primary ether amines, and tertiary aliphatic amines. Examples of primary amines include ethylamine, propylamine, butylamine, 2-ethylhexylamine, octylamine, and dodecylamine. In one embodiment, the primary amine is a fatty ($C_{8-30}$) amine, which include n-octylamine, n-decylamine, n-dodecylamine, n-tetradecylamine, n-hexadecylamine, n-octadecylamine, oleyamine, etc. Other useful fatty amines include commercially available fatty amines, such as "Armeen" amines (products available from Akzo Chemicals, Chicago, Ill.). These amines include Armeen C, Armeen O, Armeen OL, Armeen T, Armeen HT, Armeen S and Armeen SD, wherein the letter designation relates to the fatty group, such as cocoa, oleyl, tallow, or stearyl groups.

Other useful primary amines include primary ether amines, such as those represented by the formula, $R''(OR')_xNH_2$, wherein R' is a divalent alkylene group having from about 2 to about 6 carbon atoms; x is a number from one to about 150, or from one to about five, or one; and R" is a hydrocarbyl group of about 5 to about 150, or from 6 to about 24 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$, etc.) of the SURFAMS described above and used hereinafter are approximate and include the oxygen ether linkage.

In one embodiment, the amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary aliphatic primary amines are monoamines represented by the formula $R_1—C(R_1')_2—NH_2$, wherein $R_1$ is a hydrocarbyl group containing from one to about 27 carbon atoms and $R_1'$ is a hydrocarbyl group containing from 1 to about 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

Mixtures of tertiary-aliphatic primary amines are also useful for the purposes of this invention. Illustrative of amine mixtures of this type are "Primene 81R" which is a mixture of $C_{11}$–$C_4$ tertiary alkyl primary amines and "Primene JMT" which is a similar mixture of $C_{18}$–$C_{22}$ tertiary alkyl primary amines (both are available from Rohm and Haas Company). The tertiary alkyl primary amines and methods for their preparation are known to those of ordinary skill in the art. The tertiary alkyl primary amines and methods for their preparation are described in U.S. Pat. No. 2,945,749 which is hereby incorporated by reference for its teaching in this regard.

In another embodiment, the amine is a secondary amine. Specific of secondary amines include dimethylamine, diethylamine, dipropylamine, dibutylamine, diamylamine, dihexylamine, diheptylamine, methyl, ethylamine, ethyl, butylamine, ethyl, amylamine and the like. In one embodiment, the secondary amines may be cyclic amines, such as piperidine, piperazine, morpholine, etc.

In one embodiment, the dithiocarbamate compound (A) is prepared by reacting one or more of dithiocarbamic acids or salts with unsaturated reagents, such as the above described unsaturated amides, unsaturated anhydrides, acids, or esters, unsaturated ethers. The unsaturated ethers contain from 3 to about 30, or from about 4 to about 24 carbon atoms. The unsaturated ethers include methyl vinyl ether, propyl vinyl ether, 2-ethyl hexyl vinyl ether, etc.

In another embodiment, the dithiocarbamate compound is an alkylene-coupled dithiocarbamate. The alkylene-coupled dithiocarbamates may be prepared by the reaction of a salt of a dithiocarbamic acid, described above, with a suitable dihalogen containing hydrocarbon. U.S. Pat. No. 3,876,550, issued to Holubec, describes alkylene dithiocarbamate compounds and their preparation, and U.S. Pat. Nos. 1,726,647 and 1,736,429, issued to Cadwell, describe phenylmethylene bis(dithiocarbamates) and methods of making the same. These patents are incorporated by reference for their teachings related to dithiocarbamate compounds and methods for preparing the same. In one embodiment, the alkylene-coupled dithiocarbamate is derived from di-n-butyl amine, carbon disulfide and methylene dichloride.

In another embodiment, the dithiocarbamate compound is a bis(S-alkyldithiocarbamoyl)disulfide. These materials have previously been referred to as sulfur-coupled dithiocarbamates. The disulfides are prepared by (A) reacting a sulfur halide with about a stoichiometric equivalent of (i) at least one olefinic hydrocarbon, or (ii) an aldehyde or ketone, at a temperature and for a period of time sufficient to produce a di(halohydrocarbyl)sulfur intermediate or a dialdehyde or diketo sulfur intermediate, and (B) reacting the intermediate with a salt of a dithiocarbamate in an amount sufficient generally to replace both halo groups with the dithiocarbamate groups or to react with both carbonyl groups of the dialdehyde or diketone. The sulfur halide utilized in the first step (A) may be sulfur monochloride (i.e., $S_2Cl_2$), sulfur dichloride, sulfur monobromide, sulfur dibromide, or mixtures of any of the above sulfur halides with elemental sulfur in varying amounts.

The olefin may be any of the olefins described herein. The aldehydes include acetaldehyde, propionaldehyde, butyraldehyde, isobutyraldehyde, 2-ethyl-hexanal, and cyclohexanecarboxaldehyde. Examples of ketones include dimethyl ketone, methyl ethyl ketone, diethyl ketone, methyl isopropyl ketone, methyl isobutyl ketone, etc.

The bis(S-alkyldithiocarbamoyl)disulfides also may be prepared by a process which comprises the steps of (A) reacting an olefinic hydrocarbon with a halogen to produce a halogen-containing intermediate, and (B) reacting said intermediate with an alkali metal sulfide and a salt of a dithiocarbamate in an amount sufficient to replace the halogen groups present partially with dithiocarbamate groups and/or partially with sulfide groups. The bis(S-alkyldithiocarbamoyl)disulfides are described in U.S. Pat. No. 2,599,350, issued to Rudel et al and U.S. Pat. No. 5,141,658, issued to DiBiase. These patents are incorporated by reference for their disclosure of bis(S-alkyldithiocarbamoyl)disulfide.

Phosphorus Compounds (D)

The lubricating compositions, and concentrates may include a phosphorus compound as the antiwear and extreme pressure agent (D). Typically, the phosphorus containing antiwear or extreme pressure agent is present at a level from about 0.01% to about 10%, or from about 0.05% or to about 4%, or from about 0.08% to about 3%, or from 0.1% to about 2% by weight in the lubricating composition. The phosphorus compound is selected from the group consisting of a phosphoric acid ester or salt thereof, a metal dithiophosphate, a reaction product of a phosphite and sulfur or a source of sulfur, a phosphite, a reaction product of a phosphorus acid or anhydride and an unsaturated compound, and mixtures of two or more thereof.

In one embodiment, the phosphorus compound (D) is a phosphorus acid ester. The ester is prepared by reacting one or more phosphorus acids or anhydrides with at least one alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, $C_{1-7}$ phosphorus esters, and phosphorus sulfides, which include phosphorus pentasulfide, phosphorus sesquisulfide, phosphorus heptasulfide and the like.

The alcohols generally contain from one to about 30, or from two to about 24, or from about 3 to about 12 carbon atoms. The alcohols include propyl, butyl, amyl, 2-ethylhexyl, hexyl, octyl, oleyl, and cresol alcohols. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography); and Alfol 22+ alcohols ($C_{18}$–$C_{28}$ primary alcohols containing primarily $C_{22}$ alcohols). Alfol alcohols are available from Continental Oil Company. Examples of a commercially available alcohol mixtures are Adol 60 (about 75% by weight of a straight chain $C_{22}$ primary alcohol, about 15% of a $C_{20}$ primary alcohol and about 8% of $C_{18}$ and $C_{24}$ alcohols) and Adol 320 (oleyl alcohol). The Adol alcohols are marketed by Ashland Chemical.

A variety of mixtures of monohydric fatty alcohols derived from naturally occurring triglycerides and ranging in chain length from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$, $C_{13}$, $C_{14}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

The alcohol may also be a fatty vicinal diol. Fatty vicinal diols include those available from Ashland Oil under the general trade designation Adol 114 and Adol 158. The former is derived from a straight chain α-olefin fraction of $C_{11}$–$C_{14}$, and the latter is derived from a $C_{15}$–$C_{18}$ α-olefin fraction.

In one embodiment, the phosphoric acid ester is prepared by reacting one or more of the above alcohols with one or more of the above phosphors reagents. Examples of phosphorus acid esters include phosphoric acid di- and tri- esters prepared by reacting a phosphoric acid or anhydride with cresol alcohols, e.g. tricresylphosphate.

In one embodiment, the phosphorus compound (D) is a phosphorus ester prepared by reacting one or more dithiophosphoric acid with an epoxide or a glycol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is preferred. The glycols may be aliphatic glycols, having from 1 to about 12, or from about 2 to about 6, or from about 2 to about 3 carbon atoms, or aromatic glycols. Glycols include ethylene glycol, propylene glycol, catechol, resorcinol, and the like. The dithiophosphoric acids, glycols, epoxides, inorganic phosphorus reagents and methods of reacting the same are described in U.S. Pat. No. 3,197,405 and U.S. Pat. No. 3,544,465 which are incorporated herein by reference for their disclosure to these.

The following Examples P-1 and P-2 exemplify the preparation of useful phosphorus acid esters.

EXAMPLE P-1

Phosphorus pentoxide (64 grams) is added at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C). The mixture is heated at 75° C. for 2.5 hours, mixed with a diatomaceous earth and filtered at 70° C. The filtrate contains 11.8% by weight phosphorus, 15.2% by weight sulfur, and has an acid number of 87 (bromophenol blue).

EXAMPLE P-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate contains 15.3% by weight phosphorus, 19.6% by weight sulfur, and has an acid number of 126 (bromophenol blue).

When the phosphorus acid esters are acidic, they may be reacted with ammonia, an amine, or metal base to form the corresponding ammonium or metal salt. The salts may be formed separately and then the salt of the phosphorus acid ester is added to the lubricating or functional fluid composition. Alternatively, the salts may also be formed when the phosphorus acid ester is blended with other components to form the lubricating or functional fluid composition. The phosphorus acid ester could then form salts with basic materials which are in the lubricating composition or functional fluid composition such as basic nitrogen containing compounds (e.g., acylated amines) and overbased metal salts.

The ammonium salts of the phosphorus acid esters may be formed from ammonia, or an amine, or mixtures thereof. These amines can be monoamines or polyamines. Useful amines include those disclosed in U.S. Pat. No. 4,234,435 at Col. 21, line 4 to Col. 27, line 50, this section of this reference being incorporated herein by reference. The monoamines generally have at least one hydrocarbyl group containing from 1 to about 24 carbon atoms, with from 1 to about 12 carbon atoms being preferred, with from 1 to about 6 being more preferred. Examples of monoamines primary amines and secondary amines described above. Tertiary amines include trimethylamine, tributylamine, methyldiethylamine, ethyldibutylamine, etc.

In one embodiment, the amine may be a hydroxyamine. Typically, the hydroxyamines are primary, secondary or tertary alkanol amines or mixtures thereof. Such amines can be represented by the formulae: $H_2$—N—R'—OH, $H(R'_1)$N—R'—OH, and $(R'_1)_2$—N—R'—OH, wherein each $R'_1$ is independently a hydrocarbyl group having from one to about eight carbon atoms or hydroxyhydrocarbyl group having from one to about eight carbon atoms, or from one to about four carbon atoms, and R' is a divalent hydrocarbyl group of about two to about 18 carbon atoms, or from two to about four carbon atoms. The group —R'—OH in such formulae represents the hydroxyhydrocarbyl group. R' can be an acyclic, alicyclic or aromatic group. Typically, R' is an acyclic straight or branched alkylene group such as an ethylene, propylene, 1,2-butene, 1,2-octadecene, etc. group. Where two $R'_1$ groups are present in the same molecule they can be joined by a direct carbon-to-carbon bond or through a heteroatom (e.g., oxygen, nitrogen or sulfur) to form a 5-, 6-, 7- or 8-member ring structure. Examples of such heterocyclic amines include N-(hydroxyl lower alkyl)-morpholines, -thiomorpholines, -piperidines, -oxazolidines, -thiazoldines and the like. Typically, however, each $R'_1$ is independently a methyl, ethyl, propyl, butyl, pentyl or hexyl group. Examples of these alkanolamines include mono-, di-, and triethanolamine, diethylethanolamine, ethylethanolamine, butyldiethanolamine, etc.

The hydroxyamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl) amines can be conveniently prepared by reaction of one or more of the above epoxides with aforedescribed amines and may be represented by the formulae: $H_2N—(R'O)_x—H$, $H(R'_1)—N—(R'O)_x—H$), and $(R'_1)_2—N—(R'O)_x—H$, wherein x is a number from about 2 to about 15 and $R_1$ and R' are as described above. $R'_1$ may also be a hydroxypoly(hydrocarbyloxy) group.

In another embodiment, the amine is a hydroxyamine which may be represented by the formula $$R_1\left(N-R_3\right)_y-\underset{\substack{|\\(R_2O)_zH}}{N}-\underset{\substack{|\\(R_2O)_zH}}{N}-(R_2O)_zH$$

wherein $R_1$ is a hydrocarbyl group containing from about 6 to about 30 carbon atoms; $R_2$ is an alkylene group having from about two to about twelve carbon atoms, preferably an ethylene or propylene group; $R_3$ is an alkylene group containing from 1 to about 8, or from 1 to about 5 carbon atoms; y is zero or one; and each z is independently a number from zero to about 10, with the proviso that at least one z is zero.

Useful hydroxyhydrocarbyl amines where y in the above formula is zero include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof. Also included are the comparable members wherein in the above formula at least one z is at least 2, as for example, 2-hydroxyethoxyethylhexylamine.

In one embodiment, the amine may be a hydroxyhydrocarbyl amine, where referring to the above formula, y equals zero in the above formula. These hydroxyhydrocarbyl amines are available from the Akzo Chemical Division of Akzona, Inc., Chicago, Ill., under the general trade designations "Ethomeen" and "Propomeen". Specific examples of such products include: Ethomeen C/15 which is an ethylene oxide condensate of a coconut fatty acid containing about 5 moles of ethylene oxide; Ethomeen C/20 and C/25 which are ethylene oxide condensation products from coconut fatty acid containing about 10 and 15 moles of ethylene oxide, respectively; Ethomeen O/12 which is an ethylene oxide condensation product of oleylamine containing about 2 moles of ethylene oxide per mole of amine; Ethomeen S/15 and S/20 which are ethylene oxide condensation products with stearyl amine containing about 5 and 10 moles of ethylene oxide per mole of amine, respectively; Ethomeen T/12, T/15 and T/25 which are ethylene oxide condensation products of tallow amine containing about 2, 5 and 15 moles of ethylene oxide per mole of amine, respectively; and Propomeen O/12 which is the condensation product of one mole of oleyl amine with 2 moles propylene oxide.

The amine may also be a polyamine. The polyamines include alkoxylated diamines, fatty diamines, alkylenepolyamines, hydroxy containing polyamines, condensed polyamines, and heterocyclic polyamines. Commercially available examples of alkoxylated diamines include those amines where y in the above formula is one. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylenediamines, propanediamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

In another embodiment, the amine is an alkylenepolyamine. Alkylenepolyamines are represented by the formula $HR_1N$-(Alkylene-N)$_n$—$(R_1)_2$, wherein each $R_1$ is independently hydrogen; or an aliphatic or hydroxy-substituted aliphatic group of up to about 30 carbon atoms; $\overline{M}n$ is a number from 1 to about 10, or from about 2 to about 7, or from about 2 to about 5; and the "Alkylene" group has from 1 to about 10 carbon atoms, or from about 2 to about 6, or from about 2 to about 4. In another embodiment, $R_1$ is defined the same as $R'_1$ above. Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl)amine, propylenediamine, trimethylenediamine, tripropylenetetramine, triethylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment, the polyamine is an ethylenepolyamine. Such polyamines are described in detail under the heading Ethylene Amines in Kirk Othmer's "Encyclopedia of Chemical Technology", 2d Edition, Vol. 7, pages 22–37, Interscience Publishers, New York (1965). Ethylenepolyamines are often a complex mixture of polyalkylenepolyamines including cyclic condensation products. Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. A typical sample of such ethylenepolyamine bottoms obtained from the Dow Chemical Company of Freeport, Tex. designated "E-100"

has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetraamine, 21.74% tetraethylenepentaamine and 76.61% pentaethylenehexamine and higher analogs. These alkylenepolyamine bottoms include cyclic condensation products such as piperazine and higher analogs of diethylenetriamine, triethylenetetramine and the like. These alkylenepolyamine bottoms may be reacted alone or they may be used with other amines, polyamines, or mixtures thereof.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols contain from 2 to about 40 carbon atoms, from 2 to about 20 carbon atoms; and from 2 to about 10 hydroxyl groups, or from 2 to about 6 hydroxyl groups. Polyhydric alcohols include ethylene glycols, including di-, tri- and tetraethylene glycols; propylene glycols, including di-, tri- and tetrapropylene glycols; glycerol; butanediol; hexanediol; sorbitol; arabitol; mannitol; trimethylolpropane; sucrose; fructose; glucose; cyclohexanediol; erythritol; and pentaerythritols, including di- and tripentaerythritol.

In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20, or from two to about four carbon atoms. Examples of polyhydricamines include tris-(hydroxypropyl)amine, tris-(hydroxymethyl)amino methane, 2-amino-2-methyl-1,3-propanediol, N,N,N',N'-tetrakis (2-hydroxypropyl)ethylenediamine, and N,N,N',N'-tetrakis (2-hydroxyethyl)ethylenediamine, preferably tris-(hydroxymethyl)aminomethane (THAM).

Polyamines which may react with the polyhydric alcohol or amine to form the condensation products or condensed amines, are described above. Preferred polyamines are polyalkylene polyamines such as triethylenetetramine (TETA), tetraethylenepentamine (TEPA), pentaethylenehexamine (PEHA), and mixtures of polyamines such as the above-described "amine bottoms". The amine condensates and methods of making the same are described in PCT publication WO 86/05501 and U.S. Pat. No. 5,230,714 (Steckel) which are incorporated by reference for its disclosure to the condensates and methods of making. A particularly useful amine condensate is prepared from HPA Taft Amines, amine bottoms, available commercially from Union Carbide Co., and tris(hydroxymethyl)aminomethane (THAM).

In another embodiment, the polyamines are polyoxyalkylene polyamines, e.g. polyoxyalkylene diamines and polyoxyalkylene triamines, having average molecular weights ranging from about 200 to about 4000, or from about 400 to about 2000. The preferred polyoxyalkylene polyamines include the polyoxyethylene and polyoxypropylene diamines and the polyoxypropylene triamines. The polyoxyalkylene polyamines are commercially available and may be obtained, for example, from the Jefferson Chemical Company, Inc. under the trade name "Jeffamines D-230, D-400, D-1000, D-2000, T-403, etc.". U.S. Pat. Nos. 3,804,763 and 3,948,800 are expressly incorporated herein by reference for their disclosure of such polyoxyalkylene polyamines and acylated products made therefrom.

In another embodiment, the polyamines are hydroxy-containing polyamines. Hydroxy-containing polyamine analogs of hydroxy monoamines, particularly alkoxylated alkylenepolyamines, e.g., N,N-(diethanol)ethylenediamines can also be used. Such polyamines can be made by reacting the above-described alkylene amines with one or more of the above-described alkylene oxides. Similar alkylene oxide-alkanol amine reaction products may also be used such as the products made by reacting the above described primary, secondary or tertiary alkanol amines with ethylene, propylene or higher epoxides in a 1.1 to 1.2 molar ratio. Reactant ratios and temperatures for carrying out such reactions are known to those skilled in the art. Specific examples of hydroxy-containing polyamines include N-(2-hydroxyethyl) ethylenediamine, N,N'-bis(2-hydroxyethyl) ethylenediamine, 1-(2-hydroxyethyl)-piperazine, mono (hydroxypropyl)-substituted tetraethylenepentamine, N-(3-hydroxybutyl)-tetramethylenediamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the above described polyamines are also useful.

In another embodiment, the amine is a heterocyclic amine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminokylmorpholines, N-aminoalkylthiomorpholines, N-aminoalkylpiperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-member heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic amines are also useful. Examples include N-(2-hydroxyethyl)cyclohexylamine, 3-hydroxycyclopentylamine, parahydroxyaniline, N-hydroxyethylpiperazine, and the like.

In another embodiment, the phosphorus acid ester or salt is a metal salt. The metal salts of the phosphorus acid esters are prepared by the reaction of one or more of the above metal bases with an phosphorus acid ester.

In another embodiment, the phosphorus compound (D) is a metal thiophosphate, preferably a metal dithiophosphate. The metal thiophosphates are prepared by reacting a metal base with one or more thiophosphorus acids. The thiophosphorus acid may be mono- or dithiophosphorus acids. The thiophosphorus acid may be prepared by reacting one or more of the above phosphorus sulfides with one or more of the above alcohols. Thiophosphoric acids, such as a monothiophosphorus acid, may be prepared by the reaction of a sulfur source with a dihydrocarbyl phosphite. The sulfur source may for instance be elemental sulfur, or a sulfide, such as a sulfrized olefin. Elemental sulfur is a preferred sulfur source. The preparation of monothiophosphoric acids are disclosed in U.S. Pat. No. 4,755,311 and PCT Publication WO 87/07638, which are incorporated herein by reference for their disclosure of monothiophosphoric acids, sulfur sources, and the process for making monothiophosphoric acids. Monothiophosphoric acids may also be formed in the lubricant blend by adding a dihydrocarbyl phosphite to a lubricating composition contaning a sulfur source, such as elemental, sulfur, the combination of sulfur and hydrogen sulfide and a sulfurized olefin, such as those described above. The phosphite may react with the sulfur source under blending conditions (i.e., temperatures from about 30° C. to about 100° C., or higher) to form the monothiophosphoric acid.

In another embodiment, the phosphorus acid is a dithiophosphoric acid or phosphorodithioic acid. The dithiophosphoric acid may be represented by the formula $(R_1O)_2PSSH$, wherein each $R_1$ is independently a hydrocarbyl group, containing from about 3 to about 30, or from about 3 to about 18, or from about 4 to about 12, or to about 8 carbon atoms. Examples $R_1$ include isopropyl, isobutyl, n-butyl, sec-butyl, amyl, n-hexyl, methylisobutyl carbinyl, heptyl, 2-ethylhexyl, isooctyl, nonyl, behenyl, decyl, dodecyl, tridecyl, alkylphenyl groups, or mixtures thereof. Illustrative lower alkylphenyl $R_1$ groups include butylphenyl, amylphenyl, and heptylphenyl and mixtures thereof. Examples of mixtures of $R_1$ groups include: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

Examples of metal dithiophosphates include zinc isopropyl, methylamyl dithiophosphate, zinc isopropyl isooctyl dithiophosphate, barium di(nonyl)dithiophosphate, zinc di(cyclohexyl)dithiophosphate, copper di(isobutyl) dithiophosphate, calcium di(hexyl)dithiophosphate, zinc isobutyl isoamyl dithiophosphate, and zinc isopropyl secondary-butyl dithiophosphate. In another embodiment, the metal dithiophosphates are further reacted with one or more of the above described epoxides, preferably propylene oxide. These reaction products are described in U.S. Pat. Nos. 3,213,020; 3,213,021; and 3,213,022, issued to Hopkins et al. These patents are incorporated by reference for such description of the reaction products.

The following Examples P-3 to P-7 exemplify the preparation of useful phosphorus acid ester salts.

EXAMPLE P-3

A reaction vessel is charged with 217 grams of the filtrate from Example P-1. A commercial aliphatic primary amine (66 grams), having an average molecular weight of 191 in which the aliphatic radical is a mixture of tertiary alkyl radicals containing from 11 to 14 carbon atoms, is added over a period of 20 minutes at 25°–60° C. The resulting product has a phosphorus content of 10.2% by weight, a nitrogen content of 1.5% by weight, and an acid number of 26.3.

EXAMPLE P-4

The filtrate of Example P-2 (1752 grams) is mixed at 25°–82° C. with 764 grams of the aliphatic primary amine used in of Example P-3. The resulting product has 9.95% phosphorus, 2.72% nitrogen, and 12.6% sulfur.

EXAMPLE P-5

Alfol 8–10 (2628 parts, 18 moles) is heated to a temperature of about 45° C. whereupon 852 parts (6 moles) of phosphorus pentoxide are added over a period of 45 minutes while maintaining the reaction temperature between about 45°–65° C. The mixture is stirred an additional 0.5 hour at this temperature, and is there-after heated at 70° C. for about 2–3 hours. Primene 81-R (2362 parts, 12.6 moles) is added dropwise to the reaction mixture while maintaining the temperature between about 30°–50° C. When all of the amine has been added, the reaction mixture is filtered through a filter aid, and the filtrate is the desired amine salt containing 7.4% phosphorus (theory, 7.1%).

EXAMPLE P-6

Phosphorus pentoxide (852 grams) is added to 2340 grams of iso-octyl alcohol over a period of 3 hours. The temperature increases from room temperature but is maintained below 65° C. After the addition is complete the reaction mixture is heated to 90° C. and the temperature is maintained for 3 hours. Diatomaceous earth is added to the mixture, and the mixture is filtered. The filtrate has 12.4% phosphorus, a 192 acid neutralization number (bromophenol blue) and a 290 acid neutralization number (phenolphthalein).

The above filtrate is mixed with 200 grams of toluene, 130 grams of mineral oil, 1 gram of acetic acid, 10 grams of water and 45 grams of zinc oxide. The mixture is heated to 60°–70° C. under a pressure of 30 mm Hg. The resulting product mixture is filtered using a diatomaceous earth. The filtrate has 8.58% zinc and 7.03% phosphorus.

EXAMPLE P-7

Phosphorus pentoxide (208 grams) is added to the product prepared by reacting 280 grams of propylene oxide with 1184 grams of O,O'-diisobutylphosphorodithioic acid at 30°–60° C. The addition is made at a temperature of 50°–60° C. and the resulting mixture is then heated to 80° C. and held at that temperature for 2 hours. The commercial aliphatic primary amine identified in Example P-3 (384 grams) is added to the mixture, while the temperature is maintained in the range of 30°–60° C. The reaction mixture is filtered through diatomaceous earth. The filtrate has 9.31% phosphorus, 11.37% sulfur, 2.50% nitrogen, and a base number of 6.9 (bromophenol blue indicator).

In another embodiment, phosphorus compound (B) is a metal salt of (a) at least one dithiophosphoric acid and (b) at least one aliphatic or alicyclic carboxylic acid. The dithiophosphoric acids are described above. The carboxylic acid may be a monocarboxylic or polycarboxylic acid, usually containing from 1 to about 3, or just one carboxylic acid group. The preferred carboxylic acids are those having the formula RCOOH, wherein R is a hydrocarbyl group, preferably free from acetylenic unsaturation. Generally, R contains from about 2 to about 40, or from about 3 to about 24, or from about 4 to about 12 carbon atoms. In one embodiment, R contains from about 4 to about 12, or from about 8 to about 12, or to about 8 carbon atoms. In one embodiment, R is an alkyl group. Suitable acids include the butanoic, pentanoic, hexanoic, octanoic, nonanoic, decanoic, dodecanoic, octodecanoic and eicosanoic acids, as well as olefinic acids such as oleic, linoleic, and linolenic acids, and linoleic dimer acid. A preferred carboxylic acid is 2-ethylhexanoic acid.

The metal salts may be prepared by merely blending a metal salt of a dithiophosphoric acid with a metal salt of a carboxylic acid in the desired ratio. The ratio of equivalents of dithiophosphoric acid to carboxylic acid is from about 0.5 to about 400 to 1. The ratio may be from 0.5 to about 200, or to about 100, or to about 50, or to about 20 to 1. In one embodiment, the ratio is from 0.5 to about 4.5 to 1, or from about 2.5 to about 4.25 to 1. For this purpose, the equivalent weight of a dithiophosphoric acid is its molecular weight divided by the number of —PSSH groups therein, and the equivalent weight of a carboxylic acid is its molecular weight divided by the number of carboxy groups therein.

A second method for preparing the metal salts is to prepare a mixture of the acids in the desired ratio, such as those described above for the metal salts of the individual metal salts, and to react the acid mixture with one of the above described metal compounds. When this method of preparation is used, it is frequently possible to prepare a salt containing an excess of metal with respect to the number of equivalents of acid present; thus the metal salts may contain as many as 2 equivalents and especially to about 1.5 equivalents of metal per equivalent of acid may be prepared. The equivalent of a metal for this purpose is its atomic weight divided by its valence. U.S. Pat. Nos. 4,308,154 and 4,417,990 describe procedures for preparing these metal salts and disclose a number of examples of such metal salts. These patents are hereby incorporated by reference for those disclosures.

In another embodiment, the phosphorus compound (D) may be a phosphite. In one embodiment, the phosphite is a di- or trihydrocarbyl phosphite. Preferably each hydrocarbyl group has from 1 to about 24 carbon atoms, or from 1 to about 18 carbon atoms, or from about 2 to about 8 carbon atoms. Each hydrocarbyl group may be independently alkyl, alkenyl, aryl, and mixtures thereof. When the hydrocarbyl group is an aryl group, then it contains at least about 6 carbon atoms; or from about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. Preferably each hydrocarbyl group is independently propyl, butyl, pentyl, hexyl, heptyl, oleyl or phenyl, more preferably butyl, oleyl or phenyl and more preferably butyl, oleyl, or phenyl. Phosphites and their preparation are known and many phosphites are available commercially. Particularly useful phosphites are dibutyl hydrogen phosphite, dioleyl hydrogen phosphite, di($C_{14-18}$) hydrogen phosphite, and triphenyl phosphite.

In one embodiment, the phosphorus compound (B) may be a reaction product of a phosphorus acid and an unsaturated compound. The unsaturated compounds include above described unsaturated amides, esters, acids, anhydrides, and ethers. The phosphorus acids are described above, preferably the phosphorus acid is a dithiophosphoric acid.

Boron-Containing Antiwear/Extreme Pressure Agents (D)

The lubricants and/or functional fluids may additionally contain a boron compound, as the antiwear or extreme pressure agent (D). In one embodiment, the boron containing antiwear/extreme pressure agent is present in the lubricants and functional fluids at a level from about 0.08% to about 4%, or from 0.1% to about 3% by weight. Examples of boron containing antiwear/extreme pressure agents include a borated dispersant; an alkli metal or a mixed alkali metal, alkaline earth metal borate; a borated overbased metal salt; a borated epoxide; and a borate ester.

In one embodiment, the boron compound is a borated dispersant. Typically, the borated dispersant contains from about 0.1% to about 5%, or from about 0.5% to about 4%, or from 0.7% to about 3% by weight boron. In one embodiment, the borated dispersant is a borated acylated amine, such as a borated succinimide dispersant. Borated dispersants are described in U.S. Pat. Nos. 3,000,916; 3,087,936; 3,254,025; 3,282,955; 3,313,727; 3,491,025; 3,533,945; 3,666,662 and 4,925,983. These references are incorporated by reference for their disclosure of borated dispersants. Borated dispersant are prepared by reaction of one or more dispersant with one or more boron compounds. The dispersants include acylated amines, carboxylic esters, Mannich reaction products, hydrocarbyl substituted amines, and mixtures thereof.

The acylated amines include reaction products of one or more carboxylic acylating agent and one or more amine. The carboxylic acylating agents include $C_{8-30}$ fatty acids, $C_{14-20}$ isoaliphatic acids, $C_{18-44}$ dimer acids, addition dicarboxylic acids, trimer acids, addition tricarboxylic acids, and hydrocarbyl substituted carboxylic acylating agents. Dimer acids are described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference. The addition carboxylic acylating agents are addition (4+2 and 2+2) products of an unsaturated fatty acid with one or more unsaturated carboxylic reagents, which are described above. These acids are taught in U.S. Pat. No. No. 2,444,328, the disclosure of which is incorporated herein by reference. In another embodiment, the carboxylic acylating agent is a hydrocarbyl substituted carboxylic acylating agent. The hydrocarbyl substituted carboxylic acylating agents are prepared by a reaction of one or more of the above olefins or polyalkenes with one or more of the above unsaturated carboxylic reagent, such as maleic anhydride. The amines may be any of those described above, preferably a polyamine, such as an alkylenepolyamine or a condensed polyamine. Acylated amines, their intermediates and methods for preparing the same are described in U.S. Pat. Nos. 3,219,666; 4,234,435; 4,952,328; 4,938,881; 4,957,649; 4,904,401; and 5,053,152. Those patents are hereby incorporated by reference for such disclosure.

In another embodiment, the dispersant may also be a carboxylic ester. The carboxylic ester is prepared by reacting at least one or more of the above carboxylic acylating agents, preferably a hydrocarbyl substituted carboxylic acylating agent, with at least one organic hydroxy compound and optionally an amine. The hydroxy compound may be an alcohol or a hydroxy containing amine. In another embodiment, the carboxylic ester dispersant is prepared by reacting the acylating agent with at least one of the above-described hydroxyamines. The alcohols are described above. Preferred alcohols are the above polyhydric alcohols, such pentaerythritol.

The polyhydric alcohols may be esterified with monocarboxylic acids having from 2 to about 30, or from about 8 to about 18 carbon atoms, provided that at least one hydroxyl group remains unesterified. Examples of monocarboxylic acids include acetic, propionic, butyric and above described fatty acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants may be prepared by any of several known methods. The method which is preferred because of convenience and the superior properties of the esters it produces, involves the reaction of the carboxylic acylating agents described above with one or more alcohol or phenol in ratios from about 0.5 equivalent to about 4 equivalents of hydroxy compound per equivalent of acylating agent. The preparation of useful carboxylic ester dispersant is described in U.S. Pat. Nos. 3,522,179 and 4,234,435, and their disclosures are incorporated by reference.

The carboxylic ester dispersants may be further reacted with at least one of the above described amines and preferably at least one of the above described polyamines, such as a polyethylenepolyamine, condensed polyamine, or a heterocyclic amine, such as aminopropylmopholine. The amine is added in an amount sufficient to neutralize any non-esterified carboxyl groups. In one embodiment, the carboxylic ester dispersants are prepared by reacting from about 1 to about 2 equivalents, or from about 1.0 to 1.8 equivalents of hydroxy compounds, and up to about 0.3 equivalent, or from about 0.02 to about 0.25 equivalent of polyamine per equivalent of acylating agent. The carboxylic acid acylating agent may be reacted simultaneously with both the hydroxy compound and the amine. There is generally at least about 0.01 equivalent of the alcohol and at least 0.01 equivalent of the amine although the total amount of equivalents of the combination should be at least about 0.5 equivalent per equivalent of acylating agent. These carboxylic ester dispersant compositions are known in the art, and the preparation of a number of these derivatives is described in, for example, U.S. Pat. Nos. 3,957,854 and 4,234,435 which have been incorporated by reference previously.

In another embodiment, the dispersant may also be a hydrocarbyl-substituted amine. These hydrocarbyl-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same. Typically, hydrocarbyl substituted amines are prepared by reacting olefins and olefin polymers, including the above polyalkenes and halogenated derivatives thereof, with amines (mono- or polyamines). The amines may be any of the amines described above, preferably an alkylenepolyamine. Examples of hydrocarbyl substituted amines include poly(propylene)amine; N,N-dimethyl-N-poly (ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-poly(butene)ethylenediamine; N-poly(propylene) trimethylenediamine; N-poly(butene)diethylenetriamine; N',N'-poly(butene)tetraethylenepentamine; N,N-dimethyl-N'-poly(propylene)-1,3-propylenediamine and the like.

In another embodiment, the dispersant may also be a Mannich dispersant. Mannich dispersants are generally formed by the reaction of at least one aldehyde, such as formaldehyde and paraformaldehyde, at least one of the above described amines, preferably a polyamine, such as a polyalkylenepolyamine, and at least one alkyl substituted hydroxyaromatic compound. The amounts of the reagents is such that the molar ratio of hydroxyaromatic compound to formaldehyde to amine is in the range from about (1:1:1) to about (1:3:3). The hydroxyaromatic compound is generally an alkyl substituted hydroxyaromatic compound. This term includes the above described phenols. The hydroxyaromatic compounds are those substituted with at least one, and preferably not more than two, aliphatic or alicyclic groups having from about 6 to about 400, or from about 30 to about 300, or from about 50 to about 200 carbon atoms. These groups may be derived from one or more of the above described olefins or polyalkenes. In one embodiment, the hydroxyaromatic compound is a phenol substituted with an aliphatic or alicyclic hydrocarbon-based group having an $\overline{M}n$ of about 420 to about 10,000. Mannich dispersants are described in the following patents: U.S. Pat. No. 3,980,569; U.S. Pat. No. 3,877,899; and U.S. Pat. No. 4,454,059 (herein incorporated by reference for their disclosure to Mannich dispersants).

In one embodiment, the boron compound is an alkali or mixed alkali metal and alkaline earth metal borate. These metal borates are generally a hydrated particulate metal borate which are known in the art. Alkali metal borates include mixed alkali and alkaline metal borates. These metal borates are available commercially. Representative patents disclosing suitable alkali and alkali metal and alkaline earth metal borates and their methods of manufacture include U.S. Pat. Nos. 3,997,454; 3,819,521; 3,853,772; 3,907,601; 3,997,454; and 4,089,790. These patents are incorporated by reference for their disclosures of the metal borates and methods of their manufacture.

In another embodiment, the boron compound is a borated fatty amine. The borated amines are prepared by reacting one or more of the above boron compounds with one or more of the above fatty amines, e.g., an amine having from about four to about eighteen carbon atoms. The borated fatty amines are prepared by reacting the amine with the boron compound from about 50° C. to about 300° C., or from about 100° C. to about 250° C., and at a ratio from about 3:1 to about 1:3 equivalents of amine to equivalents of boron compound.

In another embodiment, the boron compound is a borated epoxide. The borated fatty epoxides are generally the reaction product of one or more of the above boron compounds with at least one epoxide. The epoxide is generally an aliphatic epoxide having from 8 to about 30, or from about 10 to about 24, from about 12 to about 20 carbon atoms. Examples of useful aliphatic epoxides include heptyl epoxide, octyl epoxide, oleyl epoxide and the like. Mixtures of epoxides may also be used, for instance commercial mixtures of epoxides having from about 14 to about 16 carbon atoms and from about 14 to about 18 carbon atoms. The borated fatty epoxides are generally known and are disclosed in U.S. Pat. No. 4,584,115. This patent is incorporated by reference for its disclosure of borated fatty epoxides and methods for preparing the same.

In one embodiment, the boron compound is a borate ester. The borate esters may be prepared by reacting of one or more of the above boron compounds with one or more of the above alcohols. Typically, the alcohols contain from about 6 to about 30, or from about 8 to about 24 carbon atoms. The methods of making such borate esters are known to those in the art.

In another embodiment, borate ester is a borated phospholipid. The borated phospholipids are prepared by reacting a combination of a phospholipid and a boron compound. Optionally, the combination may include one or more of the above amines, acylated nitrogen compounds, carboxylic esters, Mannich reaction products, neutral or basic metal salts of an organic acid compounds, or mixtures of two or more thereof. These additional components are described above. Phospholipids, sometimes referred to as phosphatides and phospholipins, may be natural or synthetic. Naturally derived phospholipids include those derived from fish, fish oil, shellfish, bovine brain, chicken egg, sunflowers, soybean, corn, and cottonseeds. Phospholipids may be derived from microorganisms, including blue-green algae, green algae, and bacteria.

The reaction of the phospholipid and the boron compound usually occurs at a temperature from about 60° C. to about 200° C., or from about 90° C. to about 150° C. The boron compound and phospholipid are reacted at an equivalent ratio of boron to phosphorus of about 1–6:1 or about 2–4:1, or about 3:1. When the combination includes additional components (e.g. amines, acylated amines, neutral or basic meal salts, etc.), the boron compound is reacted with the mixture of the phospholipid and one or more optional ingredients in an amount of one equivalent of boron to an equivalent of the mixture of a phospholipid and an optional ingredient in a ratio from about one, or about two to about six, to about four to one. The equivalents of the mixture are based on the combined equivalents of phospholipid based on phosphorus and equivalents of the optional ingredients.

Antioxidants (E)

In another embodiment, the lubricating compositions and the concentrates may contain (E) one or more antioxidant. In one embodiment, the antioxidant is present in an amount from about 0.001% to about 5%, or from about 0.01% to about 2%, or from about 0.05% to about 1% by weight of the lubricating composition. The antioxidants may be present in a total amount generally from about 1.5% up to about 10%, or about 1.8% up to about 8%, or from about 1.9% up to about 6% by weight. In another embodiment, the lubricating composition contains at least about 1% by weight of an amine antioxidant, a dithiocarbamate antioxidant, or mixture thereof. In this embodiment, the lubricating compositions have at least about 1%, or from about 1.5%, or from about 1.7% by weight of an amine antioxidant, a dithiocarbamate antioxidant, or mixture thereof, preferably an amine antioxidant. In another embodiment, the antioxidant is present in an amount to deliver at least about 0.04%, or at least about 0.05%, or at least about 0.07% by weight nitrogen to the fully formulated lubricant. In one embodiment, the antioxidant include amine antioxidants, dithiophosphoric acid esters, phenol antioxidants, dithiocarbamates, phosphite antioxidants, sulfurized Diels-Alder adducts, and mixtures thereof. In one embodiment, the antioxidant is an amine antioxidant, or a dithiocarbamate antioxidant. In one embodiment, the antioxidants are ashless, i.e., free of metal. In another embodiment the antioxidant is other than a polyphenol.

Amine antioxidants include alkylated aromatic ambles and heterocyclic amines. The alkylated aromatic amines include compounds represented by the formula $Ar^1$—$NR_1$—$Ar^2$, wherein $Ar^1$ and $Ar^2$ are independently mononuclear or polynuclear, substituted or unsubstituted aromatic groups; and $R_1$ is hydrogen, halogen, OH, $NH_2$, SH, $NO_2$ or a hydrocarbyl group having from 1 to about 50 carbon atoms. The aromatic group as represented by "Ar", as well as elsewhere in other formulae in this specification and in the appended claims, may be mononuclear or polynuclear. Examples of mononuclear Ar moieties include benzene moieties, such as 1,2,4-benzenetriyl; 1,2,3-benezenetriyl; 3-methyl-1,2,4-benzenetriyl; 2-methyl-5-ethyl-1,3,4-benzenetriyl; 3-propoxy-1,2,4,5-benzenetetrayl; 3-chloro-1,2,4-benzenetriyl; 1,2,3,5-benzenetetrayl; 3-cyclohexyl-1,2,4-benzenetriyl; and 3-azocyclopentyl-1,2,5-benzenetriyl, and pyridine moieties, such as 3,4,5-azabenzene; and 6-methyl-3,4,5-azabenzene. The polynuclear groups may be those where an aromatic nucleus is fused at two points to another aromatic nucleus, such as naphthyl and anthracenyl groups. Specific examples of fused ring aromatic moieties Ar include: 1,4,8-naphthylene; 1,5,8-naphthylene; 3,6-dimethyl-4,5,8(1-azonaphthalene); 7-methyl-9-methoxy-1,2,5, 9-anthracenetetrayl; 3,10-phenathrylene; and 9-methoxybenz(a)phenanthrene-5,6,8,12-yl. The polynuclear group may be those where at least two nuclei (either mononuclear or polynuclear) are linked through bridging linkages. These bridging linkages may be chosen from the group consisting of alkylene linkages, ether linkages, keto linkages, sulfide linkages, and polysulfide linkages of 2 to about 6 sulfur atoms. Specific examples of Ar when it is linked polynuclear aromatic moiety include: 3,3',4,4',5-bibenzenetetrayl; di(3,4-phenylene)ether; 2,3-phenylene-2,6-naphthylenemethane; and 3-methyl,9H-fluorene-1,2,4,5,8-yl; 2,2-di(3,4-phenylene)propane; sulfur-coupled 3-methyl-1,2,4-benzatriyl (having 1 to about 10 thiomethylphenylenegroups); and amino-coupled 3-methyl-1,2,4-benzatriyl (having 1 to about 10 aminomethylphenylene groups). Typically Ar is a benzene nucleus, lower alkylene bridged benzene nucleus, or a naphthalene nucleus.

In another embodiment, the alkylated aromatic amine is represented by the formula $R_2$—Ar—NH—Ar—$R_3$, wherein $R_2$ and $R_3$ are independently hydrogen or hydrocarbyl groups having from 1 to about 50, or from about 4 to about 20 carbon atoms. Examples of aromatic amines include p,p'-dioctyldiphenylamine; octylphenylbeta-naphthylamide; octylphenyl-α-naphthylamine, phenyl-α-naphthylamine; phenylbeta-naphthylamine; p-octylphenyl-α-naphthylamine and 4-octylphenyl-1-octyl-betanaphthylamine and di(nonylphenyl)amine, with di(nonylphenyl)amine preferred. U.S. Pat. Nos. 2,558,285; 3,601,632; 3,368,975; and 3,505,225 disclose diarylamines useful as antioxidant (E). These patents are incorporated herein by reference.

In another embodiment, the antioxidant (E) may be a phenothiazine. Phenothiazines include phenothiazine, substituted phenothiazine, or derivatives, such as those represented by the formula

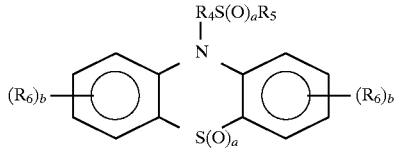

(I)

wherein $R_4$ is an alkylene, alkenylene or an aralkylene group, or mixtures thereof, $R_5$ is selected from the group consisting of higher alkyl groups, or an alkenyl, aryl, alkaryl or aralkyl group and mixtures thereof; each $R_6$ is independently alkyl, alkenyl, aryl, alkyl, arylalkyl, halogen, hydroxyl, alkoxy, alkylthio, arylthio, or fused aromatic rings, or mixtures thereof; a and b are each independently 0 or greater. In one embodiment, $R_4$ contains from about 2 to about 8, or two or three carbon atoms. $R_5$ typically contains from about 3 to about 30, or from about 4 to about 15 carbon atoms. $R_6$ contains from 1 to about 50, or from about 4 to about 30, or from 6 to about 20 carbon atoms.

In another embodiment, the phenothiazine derivatives may be represented by the formula

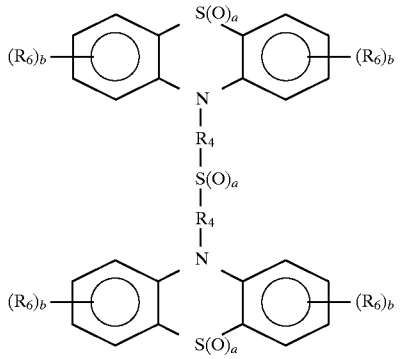

(II)

wherein $R_4$, $R_6$, a and b are as defined with respect to Formula I.

The above-described phenothiazine derivatives, and methods for their preparation are described in U.S. Pat. No. 4,785,095, and the disclosure of this patent is hereby incorporated by reference for its teachings of such methods and compounds. In one embodiment, a dialkyldiphenylamine is treated with sulfur at an elevated temperature such as in the range of 145° C. to 205° C. for a sufficient time to complete the reaction. A catalyst such as iodine may be utilized to establish the sulfur bridge.

Phenothiazine and its various derivatives may be converted to the above compounds by contacting the phenothiazine compound contaning the free NH group with a thioalcohol of the formula $R_5SR_4OH$ where $R_4$ and $R_5$ are defined with respect to Formula I. The thioalcohol may be obtained by the reaction of a mercaptan (e.g. a $C_{4-30}$ mercaptan), such as hexanethiol, octanethiol and dodecanethiol, with an alkylene oxide, such as ethylene or propylene oxide under basic conditions. Alternatively, the thioalcohol may be obtained by reacting a terminal olefin, such as those described herein, with mercaptoethanol under free radical conditions. When it is desired to prepare compounds of the type represented by Formulae I and II wherein a is 1 or 2, i.e., sulfones or sulfoxides, the derivatives prepared by the reaction with the thioalcohols described above are oxidized with an oxidizing agent, such as hydrogen peroxide, in a solvent such as glacial acetic acid or ethanol under an inert gas blanket. The partial oxidation takes place conveniently at from about 20° C. to about 150° C.

In one embodiment, the antioxidant may be one or more of the above phosphorus esters which are reaction products of one or more of the above phosphorus reagents and one or more of the above unsaturated compounds. The thiophosphorus acid esters may be mono- or dithiophosphorus acid esters. Thiophosphorus acid esters are also referred to generally as dithiophosphates.

The reaction products of phosphoric acids and an unsaturated amide are referred to as phosphorus contaning amides. An example of such reaction product is the reaction of methylamyl dithiophosphoric acid or isooctyl, isopropyl dithiophosphoric acid and acrylamide. The phosphorus containing amides are known in the art and are disclosed in U.S. Pat. Nos. 4,670,169, 4,770,807, and 4,876,374 which are incorporated by reference for their disclosures of phosphorus amides and their preparation. Examples of reaction products of a phosphoric acid and an unsaturated ester are the reaction product of isobutyl, amyl dithiophosphoric acid and methyl acrylate and di(amyl)dithiophosphoric acid and butyl methacrylate.

In another embodiment, the antioxidant (E) is at least one phenol antioxidant. The phenol antioxidants include metal and metal free hindered phenols. Alkylene coupled derivatives of hindered phenols and phenol sulfides or sulfur coupled phenols may also be used. Hindered phenols are defined as those containing a sterically hindered hydroxyl group, and these include those derivatives of dihydroxy aryl compounds wherein the hydroxyl groups are in the o- or p-position to each other. The metal-free hindered phenols may be represented by the following formulae:

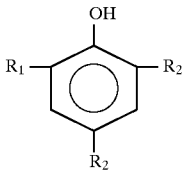

(III)

-continued

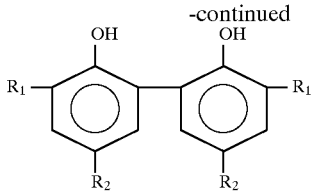

(IV)

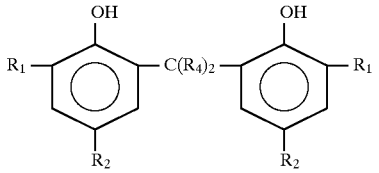

(V)

wherein each $R_1$ is independently a hydrocarbyl group containing from 3 to about 9 carbon atoms, each $R_2$ is hydrogen or a hydrocarbyl group, $R_3$ is hydrogen or a hydrocarbyl group contaning from 1 to about 9 carbon atoms, and each $R_4$ is independently hydrogen or a methyl group. In one embodiment, $R_2$ is an alkyl group containing from about 3 to about 50, or from about 6 to about 20, or from about 6 to about 12 carbon atoms. In one embodiment alkyl groups are derived from one or more of the above polyalkenes. The alkyl groups may be derived from polymers of ethylene, propylene, 1-butene and isobutene, preferably propylene tetramer or trimer. Examples of $R_2$ groups include hexyl, heptyl, octyl, decyl, dodecyl, tripropenyl, tetrapropenyl, etc. Examples of $R_1$, $R_2$ and $R_3$ groups include propyl, isopropyl, butyl, sec-butyl, tert-butyl, heptyl, octyl, and nonyl. In another embodiment, each $R_1$ and $R_3$ are tertiary groups, such as tert-butyl or tert-amyl groups. The phenolic compounds may be prepared by various techniques, and in one embodiment, such phenols are prepared in stepwise manner by first preparing the para-substituted alkylphenol, and thereafter alkylating the para-substituted phenol in the 2- and/or 6-position as desired. When it is desired to prepare coupled phenols of the type represented by Formulae IV and V, the second step alkylation is conducted under conditions which result in the alkylation of only one of the positions ortho to the hydroxyl group. Examples of useful phenolic materials include: 2-t-butyl4-heptylphenol; 2-t-butyl-4-octylphenol; 2-t-butyl4-dodecylphenol; 2,6di-t-butyl- 4butylphenol; 2,6-di-t-butyl-4-heptylphenol; 2,6di-t-butyl-4-dodecylphenol; 2,6-di-t-butyl-tetrapropenylphenol; 2-methyl-6-di-t-butyl-4-heptylphenol; 2,6-di-t-butyl-tripropenylphenol; 2,4-dimethyl-6-t-butylphenol; 2,6-t-butyl-4-ethylphenol; 4-t-butyl catechol; 2,4-di-t-butyl-p-cresol; 2,6-di-t-butyl-4-methylphenol; and 2-methyl-6-di-t-butyl-4-dodecylphenol. Examples of the ortho coupled phenols include: 2,2'-bis(6-t-butyl-4-heptylphenol); 2,2'-bis(6-t-butyl-4-octylphenol); 2,6-bis-(1'-methylcyclohexyl-4-methylphenol; and 2,2'-bis (6-t-butyl-4-dodecylphenol).

Alkylene-coupled phenolic compounds may be prepared from the phenols by reaction of the phenolic compound with an aldehyde, typically those containing from one to about eight carbon atoms, such as formaldehyde or acetaldehyde, aldehyde precursors, such as paraformaldehyde or trioxane, or a ketone, such as acetone. The alkylene-coupled phenols may be obtained by reacting from 0.3 to about 2 moles a phenol with 1 equivalent of an aldehyde or ketone. Procedures for coupling of phenolic compounds with aldehydes and ketones are known to those in the art. Examples of phenolic compounds include 2,2'-methylenebis(6-t-butyl-4-heptylphenol); 2,2'-methylenebis(6-t-butyl-4-octylphenol); 2,2'-methylenebis(4-dodecyl-6-t-butylphenol); 2,2'- methylenebis(4-octyl-6-t-butylphenol); 2,2'-methylenebis (4-octylphenol); 2,2'-methylenebis(4-dodecylphenol); 2,2'-methylenebis(4-heptylphenol); 2,2'-methylenebis(6-t-butyl-4-dodecylphenol); 2,2'-methylenebis(6-t-butyl-4-tetrapropenylphenol); and 2,2'-methylenebis(6-t-butyl-4-butyl phenol).

In another embodiment, the antioxidant (E) is a metal-free (or ashless) alkylphenol sulfide or sulfur coupled phenols. The alkylphenols from which the sulfides are prepared also may comprise phenols of the type discussed above and represented by Formula II wherein $R_3$ is hydrogen. For example, the alkylphenols which can be converted to alkylphenol sulfides include: 2-t-butyl-4-heptylphenol; 2-t-butyl-4-octylphenol; and 2-t-butyl-4-dodecylphenol; 2-t-butyl-4-tetrapropenylphenol. The term "alkylphenol sulfides" is meant to include di-(alkylphenol) monosulfides, disulfides, and polysulfides, as well as other products obtained by the reaction of the alkylphenol with sulfur monochloride, sulfur dichloride or elemental sulfur. One mole of phenol typically is reacted with about 0.5–1.5 moles, or higher, of sulfur compound. For example, the alkylphenol sulfides are readily obtained by mixing, one mole of an alkylphenol and 0.5–2.0 moles of sulfur dichloride. The reaction mixture is usually maintained at about 100° C. for about 2–5 hours, after which time the resulting sulfide is dried and filtered. When elemental sulfur is used, temperatures from about 150°–250° C. or higher are typically used. It is also desirable that the drying operation be conducted under nitrogen or a similar inert gas. A particularly useful alkylphenol sulfide is thio-bis (tetrapropenylphenate).

Suitable basic alkylphenol sulfides are disclosed, for example, in U.S. Pat. Nos. 3,372,116; 3,410,798; and 4,021,419, which are hereby incorporated by reference. These sulfur-containing phenolic compositions described in U.S. Pat. No. 4,021,419 are obtained by sulfurizing a substituted phenol with sulfur or a sulfur halide and thereafter reacting the sulfurized phenol with formaldehyde or an aldehyde precursor, e.g., paraformaldehyde or trioxane. Alternatively the substituted phenol may be first reacted with formaldehyde or paraformaldehyde and thereafter reacted with sulfur or a sulfur halide to produce the desired alkylphenol sulfide.

In another embodiment, the antioxidant (E) is a dithiocarbamate antioxidant. The dithiocarbamate antioxidants include reaction products of a dithiocarbamic acid or salt and one or more of the above described unsaturated compounds, such as unsaturated amides, carboxylic acids, anhydrides, or esters, or ethers; alkylene-coupled dithiocarbamates; and bis(S-alkyldithiocarbamoyl)disulfides. In one embodiment, the dithiocarbamate compounds are ashless, i.e. metal free. The dithiocarbamates are described above.

In another embodiment, antioxidant is a sulfurized Diels-Alder adduct. The Sulfurized Diels-Alder adduct and its preparation are described above.

As previously indicated, the above combination of components are useful in lubricants where they can function primarily as viscosity agents, antiwear, antiweld, antiscuff, extreme pressure, and/or rust inhibiting agents. They can be employed in a variety of lubricants based on diverse oils of lubricating viscosity. These lubricants include crankcase lubricating oils for spark-ignited and compression-ignited internal combustion engines, including automobile and truck engines, two-cycle engines, aviation piston engines, marine and railroad diesel engines, and the like. They can also be used in natural gas engines, stationary power engines and turbines and the like. Automatic or manual transmission fluids, transaxle lubricants, gear lubricants, both for open and enclosed systems, tractor lubricants, metal-working lubricants, hydraulic fluids and other lubricating oil and grease compositions can also benefit from the incorporation therein of the compositions of the present invention. They may also be used in lubricants for wirerope, walking cam, slideway, rock driil, chain and conveyor belt, worm gear, bearing, and rail and flange applications. In one embodiment, the lubricants contain less than 3% by weight water, preferably less than 2% by weight water.

Other Additives

The invention also contemplates the use of other additives together with the polymers (A), fluidizing agents (B), and optional antiwear agents (D) and antioxidants (E). Such additives include, for example, detergents and dispersants, corrosion- and oxidation-inhibiting agents, pour point depressing agents, extreme pressure agents, auxiliary antiwear agents, color stabilizers and anti-foam agents. The dispersant includes carboxylic dispersants (e.g. acylated amines and carboxylic esters), amine dispersants, Mannich dispersants, post treated dispersants and polymer dispersants. The carboxylic, amine and Mannich dispersants are discussed above.

Post-treated dispersants are obtained by reacting at carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422, the disclosures of which is hereby incorporated by reference.

Polymeric dispersants are interpolymers of oil-solubilizing monomers such asdecyl methacrylate, vinyl decyl ether and high molecular weight olefins with monomers containing polar substituents, e.g., aminoalkyl acrylates or acrylamides and poly-(oxyethylene)-substituted acrylates. Examples of polymer dispersants thereof are disclosed in the following U.S. Pat. Nos. 3,329,658, 3,449,250, 3,519,656, 3,666,730, 3,687,849, and 3,702,300, the disclosures of which is hereby incorporated by reference.

Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Examples of polymer dispersants thereof are disclosed in the following U.S. Pat. Nos. 3,329,658, 3,449,250, 3,519,656, 3,666,730, 3,687,849, and 3,702,300, the disclosures of which is hereby incorporated by reference.

In one embodiment, the lubricating compositions and functional fluids contain one or more auxiliary extreme pressure and/or antiwear agents, corrosion inhibitors and/or oxidation inhibitors. Many of the above-mentioned extreme pressure agents and corrosion-oxidation inhibitors also serve as antiwear agents. In one embodiment, the lubricants are free of metal dithiophosphates, such as zinc dithiophosphates and/or chlorinated hydrocarbons, such as chlorinated wax.

The lubricating compositions and functional fluids may contain one or more pour point depressants, color stabilizers, metal deactivators and/or anti-foam agents. Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

In one embodiment, the pour point depressant is represented by the general structural formula: Ar(R)—(Ar'(R'))—Ar", wherein the Ar, Ar' and Ar" are the same as "Ar" discussed above, (R) and (R') are independently an alkylene group containing 1 to 100 carbon atoms with the proviso that at least one of (R) or (R') is $CH_2$, and n is 0 to about 1000 with the proviso that if 'n is 0, then (R) is $CH_2$ and at least one aromatic moiety has at least one substituent, the substituents being selected from the group consisting of a substituent derived from an olefin (preferably an olefin containing about 8 to about 30 carbon atoms, more preferably about 16–18 carbon atoms) and a substituent derived from a chlorinated hydrocarbon preferably containing about 8 to about 50 carbon atoms more preferably containing about 24 carbon atoms and about 2.5 chlorine atoms for each 24 carbon atoms.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

These additional additives, when used, are present in the inventive lubricating and functional fluid compositions at sufficient concentrations to provide the compositions with enhanced properties depending upon their intended use. Generally, each of these additional additives are present in the lubricants and functional fluids at concentrations from about 0.01%, or from about 0.05%, or from about 0.5%. These additional additives are generally present in an amount up to about 20% by weight, or up to about 10% by weight, and or up to about 3% by weight.

The substituents for the aromatic moieties are obtained from olefins and/or chlorinated hydrocarbons, e.g., chlorinated wax. The olefins are described above. A particularly preferred chlorinated hydrocarbon, being one of about 24 carbons, contaning about 2.5 chlorines per 24 carbon atoms.

The desired material is a mixture of products which include alkylated naphthalenes, coupled and bridged naphthalenes, oligomers and dehydrohalogenated waxes. The molecular weight distribution of the final product is a more useful characterization of the final product. A useful molecular weight range is from about 300–2000. A more useful molecular weight range is from 500 to 10,000. A preferred distribution is from 400 to 112,000. The most useful distribution is from about 271 to about 300,000. U. S. Pat. No. 1,667,214, issued to Michel; U.S. Pat. No. 1,815,022, issued to Davis, and U.S. Pat. No. 4,753,745, issued to Kostusyk et al teach such alkylated aromatic compounds useful as pour point depressants. These patents are incorporated by reference.

In another embodiment, the pour point depressant is a ester of a carboxy contaning interpolymer of an vinyl aromatic compound, (discussed above), e.g., styrene and an unsaturated carboxylic reagents (discussed above), e.g, maleic anhydride. The pour point depressant are generally referred to a maleic anhydridestyrene copolymer pour point depressants. These polymers are described in U.S. Pat. Nos. 4,284,414, 4,604,221 and 5,338,471, whose disclosure are hereby incorporated by reference.

In one embodiment, the lubricating compositions contain less than 2%, or less than 1.5%, or less than 1% by weight of a dispersant. In another embodiment, the lubricating compositions are free of lead based additives, metal (zinc) dithiophosphates, and alkali or alkaline earth metal borates.

Concentrates

The invention also includes concentrates of the polymers (A) and (B) and the fluidizing agents (C). The polymer (A) is typically present in an amount from about 22% to about 40%, or from about 24% to about 38%, or from about 26% to about 36% by weight of the concentrate. The polymer (B) is typically present in an amount from about 8% to about 40%, or from about 9% to about 38%, or from about 10% to about 35% by weight of the concentrate. The fluidizing agent is generally present in an amount from about 20% to about 70%, or from about 25% to about 65%, or from about 30% to about 60% by weight of the concentrate. The weight ratio of polymer (A) to polymer (B) is from about 0.5–5:1, or from about 0.7–4:1, or from about 1–3:1. The weight ratio of the combined amounts of polymers (A) and polymers (B) to fluidizing agent is from about 0.4–4:1, or from about 0.5–3:1, or from about 0.8–2.5:1.

The concentrates may additionally include a substantially inert organic diluent. The substantially inert, normally liquid organic solvent/diluent such as kerosene, mineral distillates, naphtha or one or more oils of lubricating viscosity. In one embodiment, the concentrates contain from 0.01% to about 49.9%, or from about 0.1% to about 45% by weight. The concentrates may contain other additives, such as those discussed above, which may be used in a fully formulated lubricating composition. These additives are present in minor amounts or from about 0.1% to about 45% by weight.

The following table examples relate to concentrates containing the components useful in the present invention. The concentrates are prepared under normal blending conditions.

| | C-1 | C-2 | C-3 | C-4 | C-5 | C-6 | C-7 | C-8 | C-9 | C-10 |
|---|---|---|---|---|---|---|---|---|---|---|
| Polyisobutene (Mw = 6700) | 70 | 70 | — | 27 | 27 | 27 | — | 33 | 28 | 31 |
| Polyisobutenyl (Mw = 6700) succinic anhydride | — | — | 70 | — | — | — | 27 | — | — | — |
| Trilene CP-40 | 30 | — | — | 13 | — | — | 13 | — | — | 14 |
| Lucant HC-2000 | — | 30 | — | — | 13 | 13 | — | — | — | — |
| Product of Ex. I | — | — | 30 | — | — | — | — | — | 42 | — |

-continued

| | C-1 | C-2 | C-3 | C-4 | C-5 | C-6 | C-7 | C-8 | C-9 | C-10 |
|---|---|---|---|---|---|---|---|---|---|---|
| Product of Ex. IV | — | — | — | — | — | — | — | 33 | — | — |
| Alkylate A-215 | — | — | — | 60 | — | 60 | 60 | — | — | 54 |
| PAO (4 cSt) | — | — | — | — | — | — | — | 34 | 30 | — |
| Hydrocal 38 | — | — | — | — | 60 | — | — | — | — | — |

Typically the concentrates are used at treate levels from about 15% to about 45%, or from about 20% to about 40% by weight. Each of the above concentrates may additionally contain any of the above described components such as antiwear or extreme pressure agent, pour point depressants, dispersant, etc.

The following examples relate to lubricants containing at least polymer (A) and (B) and fluidizing agent (C).

EXAMPLE L-1

A lubricant is prepared by incorporating 27% of a polyisobutene ($\overline{M}w$=6,700), 4% of Trilene CP-40, and 10% of Monsanto Alkylate A-237 into a 100N oil.

EXAMPLE L-2

A lubricating composition is prepared as described in Example L-1 except Lucant HC-2000 is used instead of the Trilene CP-40.

EXAMPLE L-3

A lubricant is prepared as described in Example L-1 except the lubricant includes 3.2% of the product of Example S-1.

EXAMPLE L-4

A lubricant is prepare as described in Example L-1 except the lubricant include 1.2% of the product of Example P-3.

EXAMPLE L-5

A lubricant is prepared as described in Example L-1 except the lubricant includes 1.9% of a $C_9$ mono- and di-alkylated diphenylamine.

EXAMPLE L-6

A lubricant is prepared as described in Example L-2 except the lubricant also includes 1.2% of a borated dispersant prepare from polybutenyl ($\overline{M}n$=1000) succinic anhydride and polyamine bottoms, wherein the dispersant having 2.3% nitrogen, 1.9% boron, and 33% 100 neutral mineral oil.

EXAMPLE L-7

A lubricant is prepared by incorporating 15% of a polyisobutene ($\overline{M}w$=6,700), 10% of the product of Example I, 10% of a polyα-olefin having a kinematic viscosity of 4 cSt at 100° C., and 10% of Monsanto Alkylate A-237, 2.2% of $C_9$ mono- and di-alkylated diphenylamine, 1.7% of the product of Example P-3, 4.6% of the product of Example S-3, 0.05% of a reaction product of $C_9$ mercaptan and dimercaptothiadiazole, 0.1% of a reaction product of heptylphenol, formaldehyde and dimercaptothiadiazole, 0.1% of a copolymer of methylacrylate and 2-ethylhexylacrylate, 30 ppm of silicone fluid, 0.04% by weight of monoisopropanolamine into a mixture comprising 80% of a 70N mineral oil and 20% of a 130N mineral oil.

EXAMPLE L-8

A lubricating composition is prepared by incorporating 18% of the polyisobutene of Example L-1, 12% of the product of Example IV, and 10% of a 4 cSt PAO, 0.5% of $C_9$ mono- and di-alkylated diphenylamine, 4.1% of the product of Example S-4, 1.6% of the product of Example P-3, 0.8% of a reaction product of dimercaptothiadiazole and a carboxylic ester dispersant prepared by reacting a polybutenyl ($\overline{M}n$=950) substituted succinic anhydride with pentaerythritol and polyethylene polyamines, 0.3% triphenyl phosphite, 0.3% glycerol monooleate, 0.1% by weight of a polymer of vinyl acetate, ethylacrylate and 2-ethylhexylacrylate, 30 parts per million silicone antifoam agent, into 100N isomerized wax basestock.

EXAMPLE L-9

A lubricant is prepare as described in Example L-8 except 2.2% of the alkylated diphenylamine is used.

Examples L-10 through L-15 are further examples of lubricating compositions using a mixture of 20% of 148N oil and 80% of 90N oil into which is incorporated the additives described in the following table.

| | L-10 | L-11 | L-12 | L-13 | L-14 | L-15 |
|---|---|---|---|---|---|---|
| Polyisobutene ($\overline{M}n$ = 2000) | 20 | 10 | 15 | 28 | 15 | 25 |
| Trilene CP-40 | 5 | — | 5 | 3 | — | 10 |
| Product of Ex. I | — | 12 | 5 | — | 5 | — |
| 4 cSt PAO | — | 10 | 15 | — | 10 | 8 |
| Alkylate A-215 | 10. | 10 | — | 20 | — | 12 |
| $C_9$ mono- and di-alkylated diphenylamine | 1.5 | — | 2.2 | — | 2.2 | 3.3 |
| Methylene bis (di-n-butyldithiocarbamate) | 1 | 2.5 | — | — | — | — |
| Sulfur coupied tetrapropenyl phenol | — | — | 2.5 | — | — | — |
| Borated Dispersant of Example L-6 | 0.8 | — | 0.7 | 0.7 | — | — |
| Product of Ex S-1 | — | — | 3.5 | 4.1 | 4.0 | 3.7 |
| Product of Ex P-3 | — | — | — | 1.3 | 0.8 | 1.2 |
| Reaction product of polybutenyl ($\overline{M}n$ = 850) succinic anhydride and tetraethylene pentamine | — | — | — | — | — | 0.8 |

While the invention has been explained in relation to its preferred embodiments, it is to be understood that various-modifications thereof will become apparent to those skilled in the art upon reading the specification. Therefore, it is to be understood that the invention disclosed herein is intended to cover such modifications as fall within the scope of the appended claims.

We claim:

1. A lubricating composition comprising at least about 30% by weight of at least one mineral oil, having a kinematic viscosity of less than about 8 cSt at 100° C., (A) from about 5% to about 30% by weight at least one polymer having a $\overline{M}w$ less than about 10,000, and (B) from about 2% to about 12% by weight of a polymer derived from an α-olefin which has from about 3to about 40 carbons atoms having a $\overline{M}w$ greater than about 15,000, wherein the lubricating composition has a shear loss of less than about 15% in the 20 hour taper bearing shear test.

2. The composition of claim 1 wherein (A) and (B) are independently selected from the group consisting of a polyalkene or derivative thereof, an ethylene-α-olefin copolymer, an ethylene-propylene polymer, an α-olefin-unsaturated reagent copolymer, a polyacrylate, a polymethacrylate, a hydrogenated interpolymer of a vinyl substituted aromatic compound and a conjugated diene, and mixtures thereof.

3. The composition of claim 1 wherein (A) is a polyalkene having a $\overline{M}w$ from about 1,000 up to about 9,000.

4. The composition of claim 3 wherein (A) is a polyalkene derived from at least one olefin having from 3 to about 30 carbon atoms.

5. The composition of claim 1 wherein (A) is polyisobutylene.

6. The composition of claim 1 wherein (B) has a $\overline{M}w$ from about 15,000 to about 50,000.

7. The composition of claim 1 wherein (B) is selected from the group consisting of a polyalkene and ethylene-α-olefin copolymer.

8. The composition of claim 7 wherein (B) has a polymodal molecular weight distribution.

9. The compositions of claim 1 further comprising (C) from about 5% to about 30% by weight of at least one fluidizing agent.

10. The composition of claim 9 wherein the fluidizing agent (C) is at least one member selected from the group consisting of an alkylated aromatic hydrocarbon, naphthenic oil, polyα-olefins having a kinematic viscosity from about 3 to about 20 cSt at 100° C., carboxylic acid esters, and mixtures thereof.

11. The composition of claim 1 further comprising (D) at least one antiwear or extreme pressure agent, (E) at least about 1.5% by weight of at least one antioxidant, or mixtures thereof.

12. The composition of claim 11 wherein the antiwear or extreme pressure agent (D) is at least one member selected from the group consisting of a sulfur compound, a phosphorus containing compound, a boron containing compound, and mixtures thereof.

13. The composition of claim 12 wherein the antioxidant (E) is selected from the group consisting of amine antioxidants, dithiophosphoric acid esters, phenol antioxidants, dithiocarbamate antioxidants, sulfurized Diels-Alder adducts, and mixtures thereof.

14. The composition of claim 1 wherein the lubricating composition is a gear oil.

15. A lubricating composition comprising at least about 30% by weight of a mineral oil, having a kinematic viscosity of less than about 8 cSt at 100° C., (A) from about 5% to about 30% by weight of at least one polyalkene having $\overline{M}w$ of less than 10,000, and (B) from about 2% to about 12% by weight of a polyalkene or an ethylene α-olefin copolymer having a $\overline{M}w$ greater than about 15,000, wherein the lubricating composition has a shear loss of less than about 15% in the 20 hour taper bearing shear test.

16. The composition of claim 15 wherein (A) is a polyalkene having a $\overline{M}w$ from about 1,000 up to about 9,000.

17. The composition of claim 15 wherein (A) is polybutene.

18. The composition of claim 15 wherein (B) is selected from the group consisting a polybutene and an ethylene-α-olefin copolymer.

19. The composition of claim 15 further comprising (C) from about 5% to about 30% by weight of at least one fluidizing agent.

20. The composition of claim 19 wherein the fluidizing agent (C) is at least one member selected from the group consisting of an alkylated aromatic hydrocarbon, naphthenic oil, polyα-olefins having a kinematic viscosity from about 3 to about 20 cSt at 100° C., carboxylic acid esters, and mixtures thereof.

21. The composition of claim 15 further comprising (D) from about 0.05% to about 10% at least one antiwear or extreme pressure agent, (E) at least about 1.5% by weight of at least one antioxidant, or mixtures thereof.

22. The composition of claim 15 further comprising an amount sufficient to deliver at least about 0.04% by weight nitrogen to the lubricating composition.

23. A concentrate comprising (A) from about 20% about 90% by weight of at least one polymer having a $\overline{M}w$ less than about 10,000, (B) from about 8% to about 40% by weight of a polymer having a $\overline{M}w$ greater than about 15,000, wherein a lubricating composition prepared from the concentrate has a shear loss of less than about 15% in the 20 hour Taper Bearing Shear Test.

24. The concentrate of claim 23 further comprising (C) from about 20% to about 70% by weight of at least one fluidizing agent.

* * * * *